US010144540B2

(12) United States Patent
Py et al.

(10) Patent No.: US 10,144,540 B2
(45) **Date of Patent: *Dec. 4, 2018**

(54) APPARATUS AND METHOD FOR FILLING AND RESEALING

(71) Applicant: MEDINSTILL DEVELOPMENT LLC, New Milford, CT (US)

(72) Inventors: Daniel Py, Larchmont, NY (US); Benoit Adamo, South Salem, NY (US); John Guthy, Oxford, CT (US)

(73) Assignee: MEDINSTILL DEVELOPMENT LLC, New Milford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/333,506

(22) Filed: Oct. 25, 2016

(65) Prior Publication Data

US 2017/0036788 A1 Feb. 9, 2017

Related U.S. Application Data

(60) Division of application No. 13/855,372, filed on Apr. 2, 2013, now Pat. No. 9,475,597, which is a (Continued)

(51) Int. Cl.

| | |
|---|---|
| ***B65B 7/16*** | (2006.01) |
| ***B65B 3/00*** | (2006.01) |
| ***B65B 51/22*** | (2006.01) |
| ***B65B 7/00*** | (2006.01) |
| ***B65B 37/06*** | (2006.01) |
| ***B65B 55/04*** | (2006.01) |

(Continued)

(52) U.S. Cl.

CPC ..... *B65B 7/161* (2013.01); *B65B 3/003* (2013.01); *B65B 7/00* (2013.01); *B65B 37/06* (2013.01); *B65B 43/54* (2013.01); *B65B 51/22* (2013.01); *B65B 55/04* (2013.01); *B65B 55/08* (2013.01); *B65B 57/00* (2013.01); *B65B 65/02* (2013.01)

(58) Field of Classification Search

CPC ..... B65B 3/003; B65B 7/00; B65B 43/54; B65B 55/04; B65B 55/08; B65B 57/00; B65B 65/02

USPC ..... 141/11, 69, 82, 130, 329, 330; 406/411–416; 53/425, 428

See application file for complete search history.

(56) References Cited

U.S. PATENT DOCUMENTS 2,193,059 A 3/1940 Chapman
2,503,147 A 4/1950 Applezweig
(Continued)

*Primary Examiner* — Timothy L Maust
(74) *Attorney, Agent, or Firm* — McCarter & English, LLP

(57) ABSTRACT

Apparatus for filling devices that are penetrable for filling the devices with a substance, and resealable for sealing the resulting hole. A device support supports at least one such device in a substantially fixed position relative to the support during filling and/or resealing. A manifold drivingly mounted over the device support can include (1) a cartridge including a filling needle for penetrating a resealable stopper and introducing a substance therethrough into the device, a mount for mounting the cartridge on the manifold, and a removable cover releasably coupled to the mount for covering the filling needle during transportation, installation and/or removal of the cartridge from the manifold. The manifold can include a thermal source for heating a penetrated region of the stopper and, sealing the hole.

34 Claims, 25 Drawing Sheets

Related U.S. Application Data continuation of application No. 11/901,467, filed on Sep. 17, 2007, now Pat. No. 8,408,256, which is a continuation of application No. 11/510,961, filed on Aug. 28, 2006, now Pat. No. 7,270,158, which is a continuation of application No. 11/070,440, filed on Mar. 2, 2005, now Pat. No. 7,096,896.

(60) Provisional application No. 60/550,805, filed on Mar. 5, 2004.

(51) Int. Cl.

| | |
|---|---|
| ***B65B 57/00*** | (2006.01) |
| ***B65B 43/54*** | (2006.01) |
| ***B65B 55/08*** | (2006.01) |
| ***B65B 65/02*** | (2006.01) |

(56) References Cited

U.S. PATENT DOCUMENTS

| | | | | |
|---|---|---|---|---|
| 4,586,546 | A | 5/1986 | Mezei et al. | |
| 4,951,512 | A | 8/1990 | Mazza et al. | |
| 5,067,532 | A | 11/1991 | Lang et al. | |
| 5,341,854 | A | 8/1994 | Zezulka et al. | |
| 5,641,004 | A | 6/1997 | Py | |
| 6,508,279 | B2 | 1/2003 | Siegel et al. | |
| 6,536,188 | B1 * | 3/2003 | Taggart | B67C 7/0033 141/1 |
| 7,096,896 | B2 | 8/2006 | Py | |
| 7,270,158 | B2 * | 9/2007 | Py | 141/130 |
| 7,365,343 | B2 | 4/2008 | Thilly et al. | |
| 8,408,256 | B2 | 4/2013 | Py | |

* cited by examiner

APPARATUS AND METHOD FOR FILLING AND RESEALING

CROSS-REFERENCE TO RELATED APPLICATIONS

This patent application is a divisional application of U.S. patent application Ser. No. 13/855,372, filed Apr. 3, 2013, now U.S. Pat. No. 9,475,597, which is a continuation of U.S. patent application Ser. No. 11/901,467, filed Sep. 17, 2007, now U.S. Pat. No. 8,408,256, which is a continuation of U.S. patent application Ser. No. 11/510,961, filed Aug. 28, 2006, now U.S. Pat. No. 7,270,158, which is a continuation of U.S. patent application Ser. No. 11/070,440, filed Mar. 2, 2005, now U.S. Pat. No. 7,096,896, claiming the benefit of U.S. Provisional Application No. 60/550,805, filed Mar. 5, 2004, all of which are hereby expressly incorporated by reference as part of the present disclosure.

FIELD OF THE INVENTION

The present invention relates to apparatus and methods for filling and resealing devices or containers having penetrable and resealable portions or stoppers, such as, for example, medicament vials having polymeric stoppers that are needle penetrable for filling the closed vial with a medicament or other substance therethrough and that are resealable for resealing the needle hole after filling and upon withdrawal of the needle therefrom.

BACKGROUND OF THE INVENTION

A typical medicament dispenser includes a body defining a storage chamber, a fill opening in fluid communication with the body, and a stopper or cap for sealing the fill opening after filling the storage chamber to hermetically seal the medicament within the dispenser. In order to fill such prior art dispensers with a sterile fluid or other substance, such as a medicament, it is typically necessary to sterilize the unassembled components of the dispenser, such as by autoclaving the components and/or exposing the components to gamma radiation. The sterilized components then must be filled and assembled in an aseptic isolator of a sterile filling machine. In some cases, the sterilized components are contained within multiple sealed bags or other sterile enclosures for transportation to the sterile filling machine. In other cases, the sterilization equipment is located at the entry to the sterile filling machine. In a filling machine of this type, every component is transferred sterile into the isolator, the storage chamber of the vial is filled with the fluid or other substance, the sterilized stopper is assembled to the vial to plug the fill opening and hermetically seal the fluid or other substance in the vial, and then a crimping ring is assembled to the vial to secure the stopper thereto.

One of the drawbacks associated with such prior art dispensers, and processes and equipment for filling such dispensers, is that the filling process is time consuming, and the processes and equipment are expensive. Further, the relatively complex nature of the filling processes and equipment can lead to more defectively filled dispensers than otherwise desired. For example, typically there are at least as many sources of failure as there are components. In many cases, there are complex assembly machines for assembling the vials or other dispensers that are located within the aseptic area of the filling machine that must be maintained sterile. This type of machinery can be a significant source of unwanted particles. Further, such isolators are required to maintain sterile air within the barrier enclosure. In closed barrier systems, convection flow is inevitable and thus laminar flow, or substantially laminar flow, cannot be achieved. When operation of an isolator is stopped, a media fill test may have to be performed which can last for several, if not many days, and can lead to repeated interruptions and significant reductions in production output for the pharmaceutical or other product manufacturer that is using the equipment. In order to address such production issues, government-imposed regulations are becoming increasingly sophisticated and are further increasing the cost of already-expensive isolators and like filling equipment. On the other hand, governmental price controls for injectables and vaccines, including, for example, preventative medicines, discourage such major financial investments. Accordingly, there is a concern that fewer companies will be able to afford such increasing levels of investment in sterile filling machines, thus further reducing competition in the injectable and vaccine marketplaces.

SUMMARY OF THE INVENTION

It is an object of the present invention to overcome one or more of the above-described drawbacks and disadvantages of the prior art.

In accordance with one aspect, an apparatus for filling and resealing devices having penetrable regions that are penetrable for filling the devices with a substance and are resealable for sealing a hole formed therein upon withdrawal of a filling member therefrom includes a device support movable between a plurality of positions and configured to support at least one device having a penetrable region in a substantially fixed position during filling and/or resealing a hole in the penetrable region formed upon withdrawal of a filling member therefrom, a manifold drivingly mounted over the device support when the device support is in at least one of the plurality of positions, and comprising at least one filling member for penetrating a penetrable region of a device and introducing a substance through the at least one filling member and into said device; and at least one resealing apparatus configured to reseal a hole in said penetrable region formed by the at least one filling member. In some embodiments, the resealing apparatus includes a laser device for thermally resealing a thermally resealable portion of the device having a hole or aperture in it formed by penetration thereof by a filling member.

In accordance with another aspect, the present invention is directed to an apparatus for needle filling and thermally resealing containers having stoppers that are needle penetrable for filling the containers with a substance, and are thermally resealable for thermally sealing a needle hole in the stopper upon withdrawal of a needle therefrom. The apparatus comprises a container support for supporting at least one container having a resealable stopper in a substantially fixed position during at least one of needle filling and thermally resealing a needle hole in the stopper upon withdrawal of a needle therefrom. A manifold is drivingly mounted over the container support and comprises (1) a needle cartridge including a needle for penetrating the resealable stopper and introducing a substance through the needle and into the container, a needle mount for mounting the needle cartridge on the manifold, and a needle cover releasably coupled to the needle mount for covering the needle during transportation, installation and/or removal of the needle cartridge from the manifold, and that is removable from the needle cartridge upon mounting the needle cartridge to the manifold. The manifold further includes a thermal source for heating a needle penetrated region of the stopper and, in turn, sealing a needle hole in the stopper.

In one embodiment of the present invention, the thermal source includes an output for transmitting a laser beam therefrom and onto a needle penetrated region of the stopper. One embodiment of the present invention further includes a temperature sensor for sensing the temperate of a needle penetrated region of the stopper to determine whether a needle hole therein is sealed. Preferably, the temperature sensor compares a sensed temperature to at least one predetermined temperature to determine whether a needle hole in the stopper is sealed.

In one embodiment of the present invention, the needle mount includes a plurality of axially-extending connecting portions with slots formed therebetween, and radially-extending flanges formed on the connecting portions for releasably engaging the manifold and securing the needle mount thereto.

In some embodiments of the present invention, the manifold comprises a plurality of needles, a plurality of thermal sources, and a plurality of temperature sensors. The apparatus may further comprise an e-beam source for generating an e-beam field, and the container support moves the container(s) within the e-beam field for sterilizing at least a needle penetrable and resealable portion thereof.

Exemplary embodiments of the present invention further comprise a control unit for controlling relative movement of the manifold and container support. In one such embodiment, the manifold includes a needle, a thermal energy source and a temperature sensor, and the controller controls movement of the manifold and/or container support to align the needle and an underlying needle penetrable region of the stopper, insert the needle into the stopper, introduce a substance through the needle and into an interior chamber of the container, withdraw the needle from the stopper, transmit radiation through the thermal energy source and onto a needle hole formed in the stopper to reseal the stopper, and control the temperature sensor to determine whether the needle hole is resealed. In one such embodiment, the container support includes a tray that supports thereon a plurality of containers in fixed positions relative to each other and forming a matrix with a plurality of rows and columns of containers, and the controller controls relative movement of the manifold and container support to align the needle with one or more underlying stoppers. In some such embodiments, the container support includes a drive unit for moving the container support relative to the manifold. The drive unit may include a drive belt, a lead screw, or a linear actuator, drivingly connected to the container support, for moving the container support relative to the manifold.

In exemplary embodiments of the present invention the container support includes a tray that supports thereon a plurality of containers in fixed positions relative to each other, the tray includes a plurality of connecting portions, and each connecting portion is releasably connectable to a respective container for connecting the container thereto and for releasably fixing the container on the tray. In one such embodiment, the tray further comprises a container fixture receivable within the tray and including a plurality of connecting portions thereon for releasably connecting the containers thereto. In one such embodiment, a plurality of the connecting portions are each defined by a recess for receiving therein a base portion of a respective container, and at least one flexible upstanding portion that is engageable with the base portion of the container to releasably secure the container thereto. In one such embodiment, the container fixture includes a plurality of connecting portions for releasably connecting and positioning the fixture within the tray.

Exemplary embodiments of the invention further comprise a sterilization and transport container including a housing defining an internal chamber that receives therein at least one tray including a plurality of sealed empty containers mounted thereon, an access opening formed through the housing and permitting movement of the at least one tray therethrough, a cover movable between a closing position covering the access opening and forming a substantially fluid-tight seal therebetween to seal the at least one tray within the internal chamber, and an open position permitting movement of the at least one tray therethrough, and an adhesive strip covering at least a portion of a seam formed between the housing and cover in the closed position.

In accordance with another aspect, the present invention is directed to an apparatus for needle filling and thermally resealing containers having stoppers that are needle penetrable for filling the containers with a substance, and are thermally resealable for thermally sealing a needle hole in the stopper upon withdrawal of a needle therefrom. The apparatus comprises first means for supporting at least one container having a resealable stopper in a substantially fixed position during at least one of needle filling and thermally resealing a needle hole in the stopper upon withdrawal of a needle therefrom. A manifold is drivingly mounted over the container support and comprises (1) a needle cartridge including a needle for penetrating the resealable stopper and introducing a substance through the needle and into the container, second means for mounting the needle cartridge on the manifold, and third means releasably coupled to the needle mount for covering the needle during at least one of transportation, installation and removal of the needle cartridge from the manifold, and removable from the needle cartridge upon mounting the needle cartridge to the manifold; and (2) fourth means for heating a needle penetrated region of the stopper and, in turn, sealing a needle hole in the stopper.

One advantage of the present invention is that the needle cartridge facilitates relatively rapid and safe transport, handling, installation and/or removal of the needles from the apparatus.

These and other advantages of the present invention will become more readily apparent in view of the following detailed description of the currently preferred embodiments and accompanying drawings.

DETAILED DESCRIPTION OF THE EMBODIMENTS OF THE INVENTION

Figure 1:
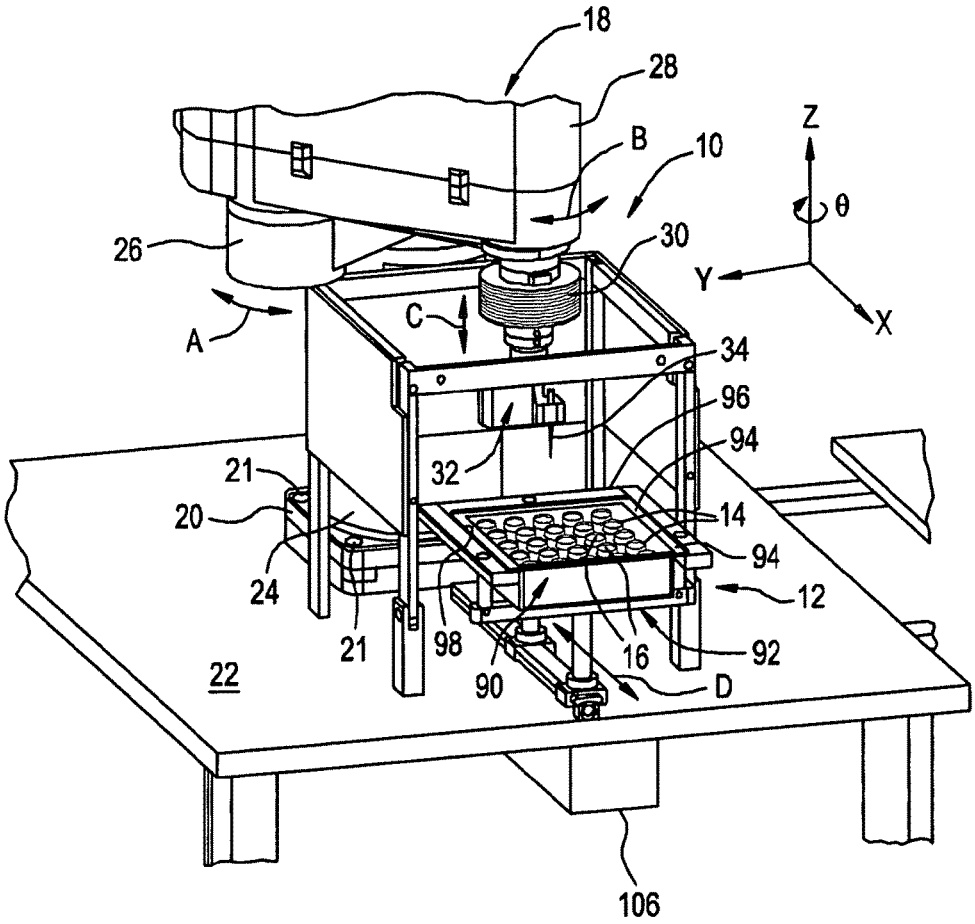
FIG. 1 is a partial, perspective view of an apparatus embodying the present invention for needle filling and laser resealing a plurality of vials or other containers with medicaments or other desired substances, showing the vial and tray assembly in the loading position and prior to movement into the filling and laser resealing position, and with some parts removed for clarity.

In FIG. 1, an apparatus embodying the present invention for needle filling and thermally resealing a plurality of vials or other containers with medicaments or other substances is indicated generally by the reference numeral 10. The apparatus 10 comprises a container support 12 for supporting at least one, and preferably a plurality of containers 14, wherein each container 14 includes a resealable stopper 16. In the illustrated embodiment, the containers 14 are vials and the resealable stoppers 16 plug the open ends of the vials. The vials and resealable stoppers may take the form of any of the numerous different vials and/or resealable stoppers as disclosed in the patent and patent applications described below, or that later become known. In addition, although the containers are illustrated as being vials, the containers may take any of numerous different shapes or configurations, such as syringes or devices for storing and dispensing either single doses or multiple doses of fluids or other substances, and the stoppers may take any desired shape or configuration as desired or otherwise required to seal an interior chamber or other portion of the container or dispenser. As described further below, the container support 12 supports the containers 14 in a substantially fixed position during (1) needle filling of the closed containers, (2) thermal resealing of the needles hole in the needle penetrated regions of the stoppers upon withdrawal of the needle therefrom, and (3) sensing the temperature of the needle-penetrated surfaces of the stoppers to determine whether the needle holes are properly sealed.

The apparatus 10 further comprises a robot 18 including a mounting flange 20 fixedly secured by fasteners, such as bolts 21, to a table or other support surface 22. For purposes of this application, the term robot means a mechanism guided by automatic controls. The robot 18 includes a base portion 24 that extends upwardly from the mounting flange 20, a first robotic arm 26 that is pivotally driven on the base 24, and a second robotic arm 26 that is pivotally driven on top of the first robotic arm 24. As indicated in FIG. 1, the first robotic arm 26 is pivotally driven in the directions of the arrow "A", and the second robotic arm 28 is pivotally driven in the directions of the arrow "B". As can be seen in FIG. 1, the directions "A" and "B" are within the X-Y coordinate plane. The robot 18 further includes a z-drive 30 that is drivingly mounted on the second robotic arm 28 and drivable in the z-axis as indicated by the arrow "C". In the illustrated embodiment, the robot 18 is a "SCARA" robot sold by Epson Corporation under the model designation "E2S SCARA", such as one of the "E2S clean robots" that is clean room capable (class 10 clean room, for example). One such model is sold by Epson under the model number "E2S451C". However, as may be recognized by those of ordinary skill in the pertinent art based on the teachings herein, these robots are only exemplary, and the robot may take the form of any of numerous different robots or like devices that are currently or later become known for performing the function of the robot 18 as described herein. In addition, the apparatus and/or method of the present disclosure may employ more than one robot to perform the functions performed by the robot 18 and/or to perform additional functions.

The apparatus 10 further comprises a tool support or manifold 32 drivingly mounted on the lower end of the z-drive 30. As shown typically in FIGS. 5 and 6, the assembled manifold 32 includes (1) a needle 34 for penetrating the resealable stoppers 16 of the closed containers 14 and introducing a substance through the needle and into the containers; (2) a thermal source 36 mounted adjacent to the needle 34 for heating a needle penetrated region of each stopper 16 and, in turn, sealing a needle hole in each penetrated stopper; and (3) a temperature sensor 38 mounted on an opposite side of the thermal source 38 relative to the needle 34 for sensing the temperate of a needle penetrated region of each stopper 16 to determine whether the needle hole was properly sealed by the thermal source. In the illustrated embodiment, the thermal source 36 is a laser optic assembly mounted within a first aperture 40 formed in the manifold 32 and coupled through a fiber optic cable 39 (FIG. 6) to a laser source 43 (FIG. 6) for transmitting laser radiation at a predetermined wavelength through the fiber optic cable 39 and laser optic assembly 36 and onto the needle penetrated regions of the stoppers for a predetermined time period to thermally reseal the stoppers. Also in the illustrated embodiment, the temperature sensor 38 is an optical sensor, such as an IR sensor, that is mounted within another mounting aperture 42 formed within the manifold 32 on an opposite side of the thermal source 36 relative to the needle 34. The IR sensor 38 is connected through a cable 41 to a computer 45 (FIG. 6) for receiving the data transmitted by the sensor and controlling operation of the apparatus based in part thereon. The laser optic assembly, fiber optic cable, laser source and IR sensor may be the same as or similar to the corresponding components described in the patent and patent applications described below. For example, in one embodiment, the laser source 43 transmits a predetermined wavelength of laser radiation at about 980 nm, and the predetermined power of the laser is less than about 30 Watts, and preferably less than or equal to about 10 Watts, or within the range of about 8 to about 10 Watts. Also in such embodiment, the laser source 43 is a semi-conductor diode laser that outputs at about 15 Watts, and is fiber-optically coupled through the fiber-optic cable 39 to the laser optic assembly 36 in the form of a collimating lens mounted within the aperture 40 in the manifold 32 for focusing the output beam of radiation onto the needle penetrated regions of the stoppers. As described further below, the apparatus 10 includes a barrier for enclosing the robot and other components within an aseptic enclosure. Preferably, the laser source 43 is mounted outside of the enclosure so that it can be easily repaired or replaced without having to access the interior of the enclosure.

Figure 5:
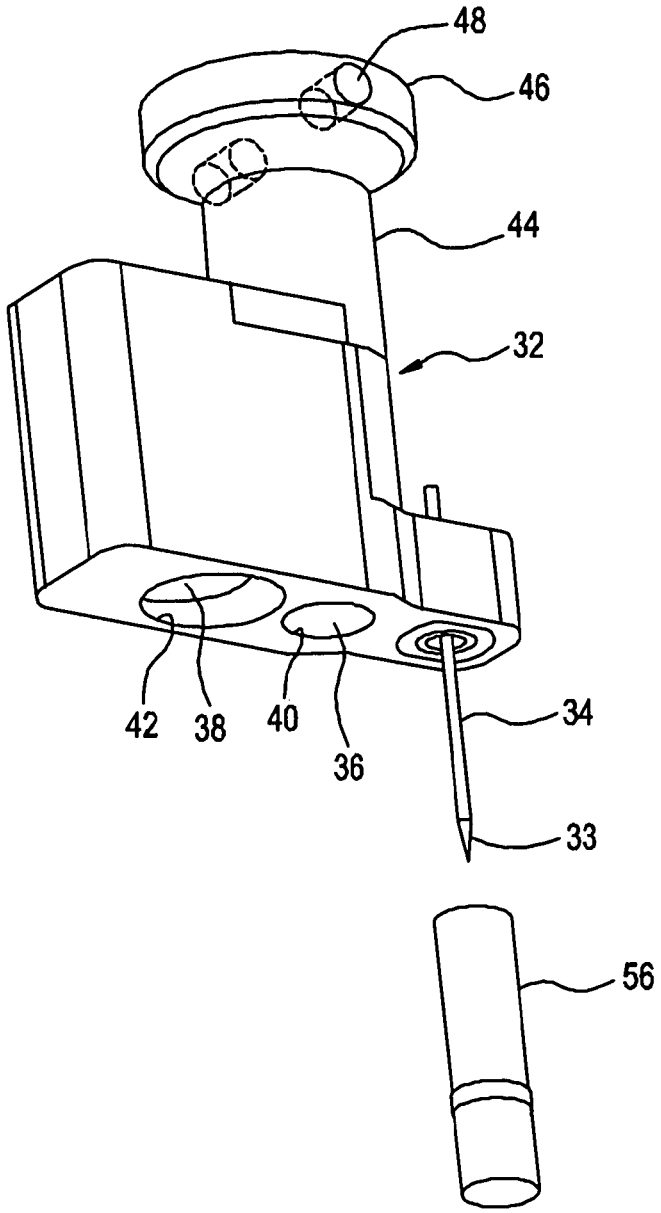
FIG. 5 is a perspective view of the tool support or manifold of the apparatus of FIG. 1 for supporting the needle, laser optic assembly and IR sensor on the robot and showing the needle cover removed from the needle cartridge.
Figure 6:
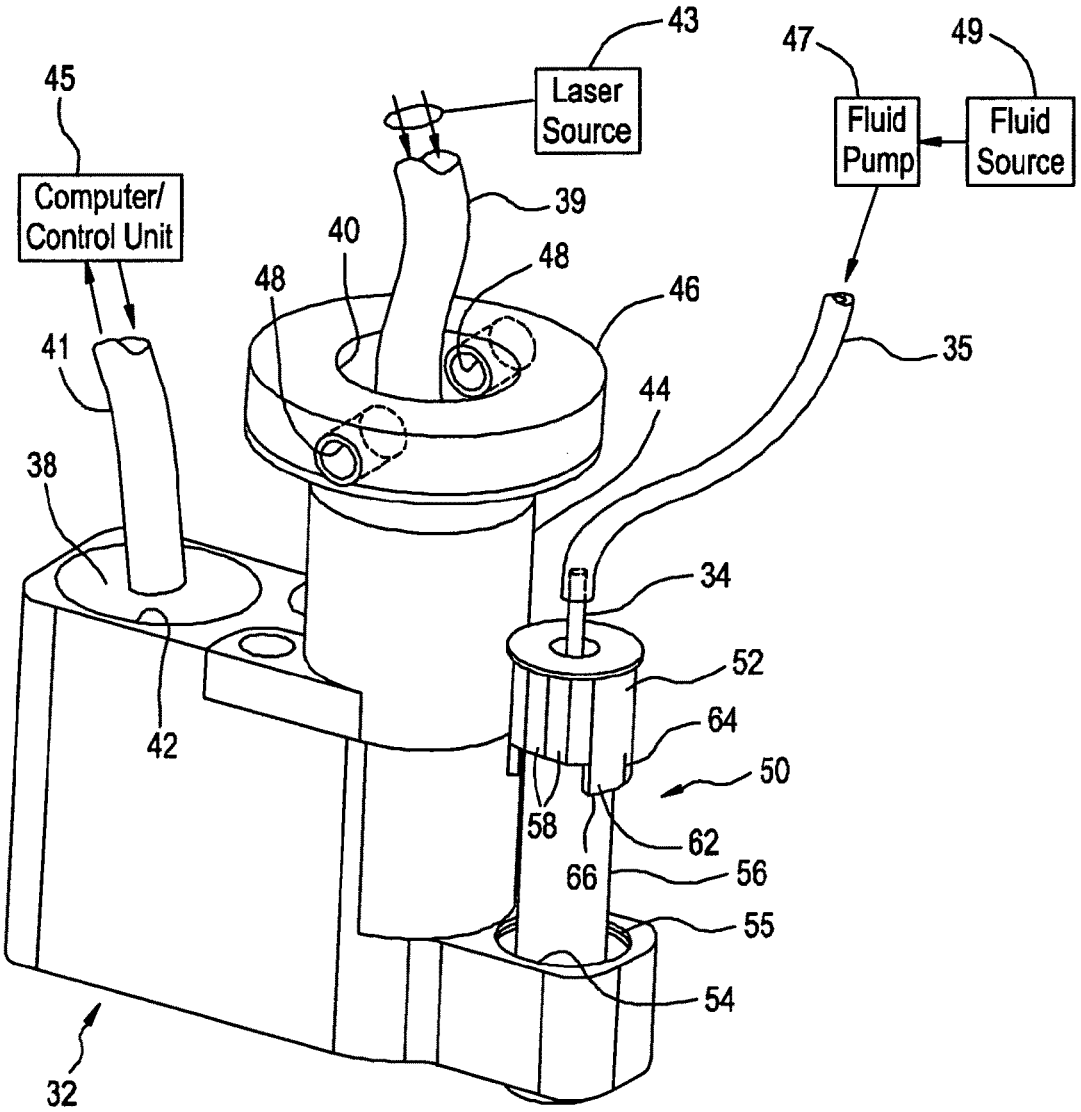
FIG. 6 is a perspective view of the manifold of FIG. 5 showing the lines connected to the IR sensor, laser optic assembly and needle, and illustrating schematically the computer, laser source, fluid pump and fluid source.

As also shown in FIGS. 5 and 6, the manifold 32 further comprises a collar 44 fixedly secured to an upper surface of the manifold, and the collar includes a mounting flange 46 defining apertures 48 for receiving fasteners (not shown) for connecting the mounting flange 46, and thus the manifold 32, to the z-drive 30 (FIG. 1). At least one pump 47 (FIG. 6) is connectable in fluid communication through a fluid line 35 between a fluid or other substance source 49 and the needle 34, such as a peristaltic pump (not shown). The pump 47, fluid source 49 and connecting line 35 may be the same as, or similar to the corresponding components described in the patent and patent applications described below. If desired, the pump(s) 47 and fluid source 49 may be mounted outside of the barrier enclosure (not shown) to facilitate repair and/or replacement of the pump(s), and/or to refill or change the product to be filled, without entering and contaminating the aseptic enclosure. The externally mounted pump 47 is connected to the needle 34 through the fluid line 35 that is formed of a type of polymeric tubing known to those of ordinary skill in the pertinent art. As described further below, the needle cartridge and respective tubing connected thereto are easily replaceable in between fills of different products or otherwise as required. In the currently preferred embodiment, the computer 45 (FIG. 6) is connected to the robot to control operation of the robot and other components of the apparatus (including the IR sensor, laser source and pump), and a printer (not shown) is connected to the computer.

Figure 7:
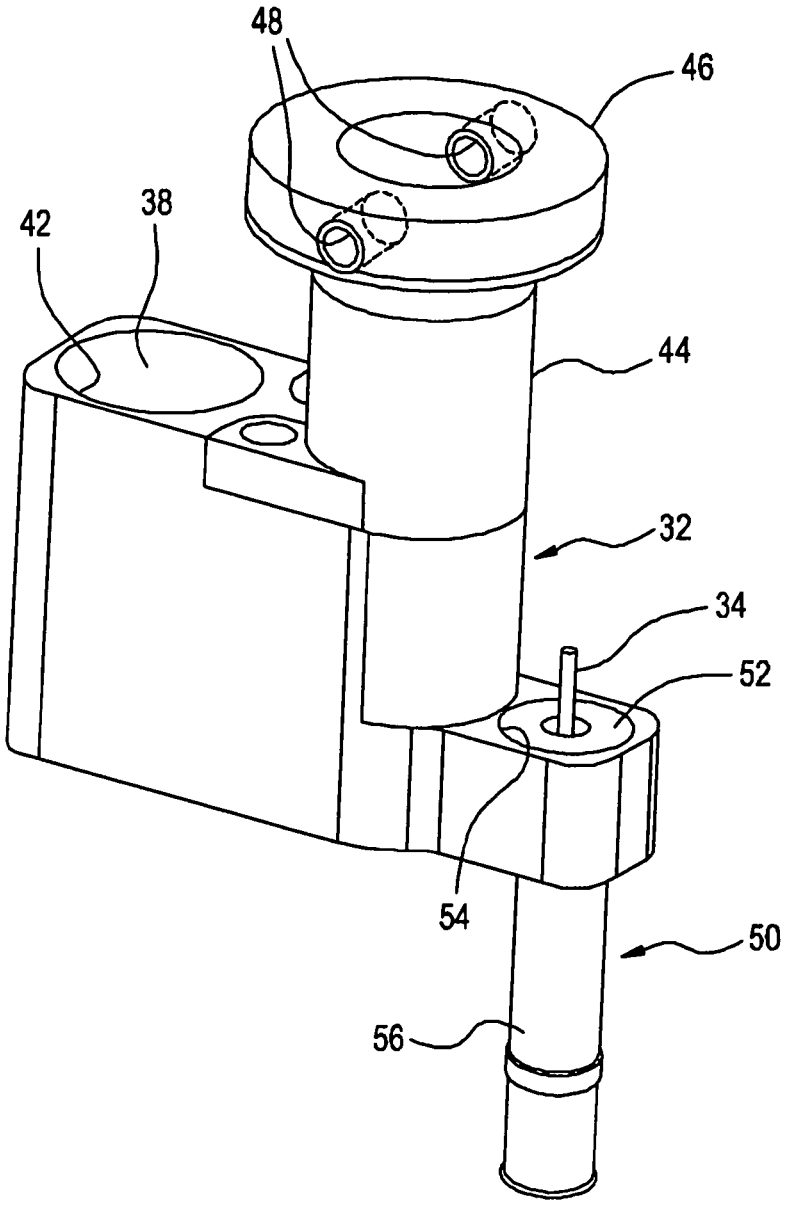
FIG. 7 is another perspective view of the manifold showing the needle cover releasably secured to the needle cartridge.
Figure 8:
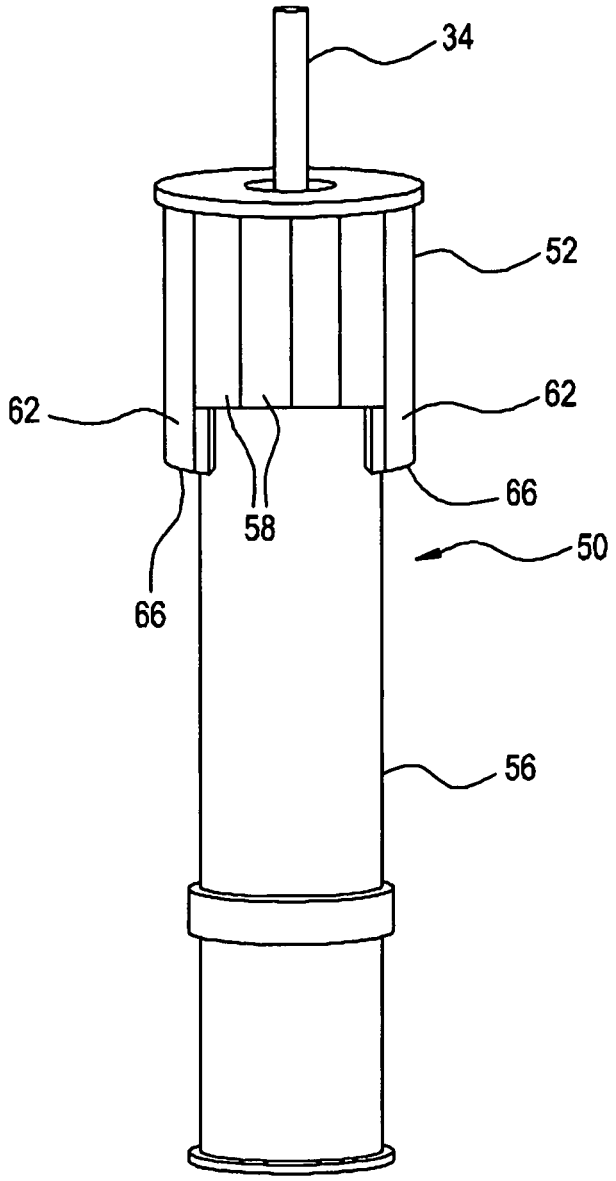
FIG. 8 is a perspective view of the needle cartridge of FIG. 7.
Figure 9:
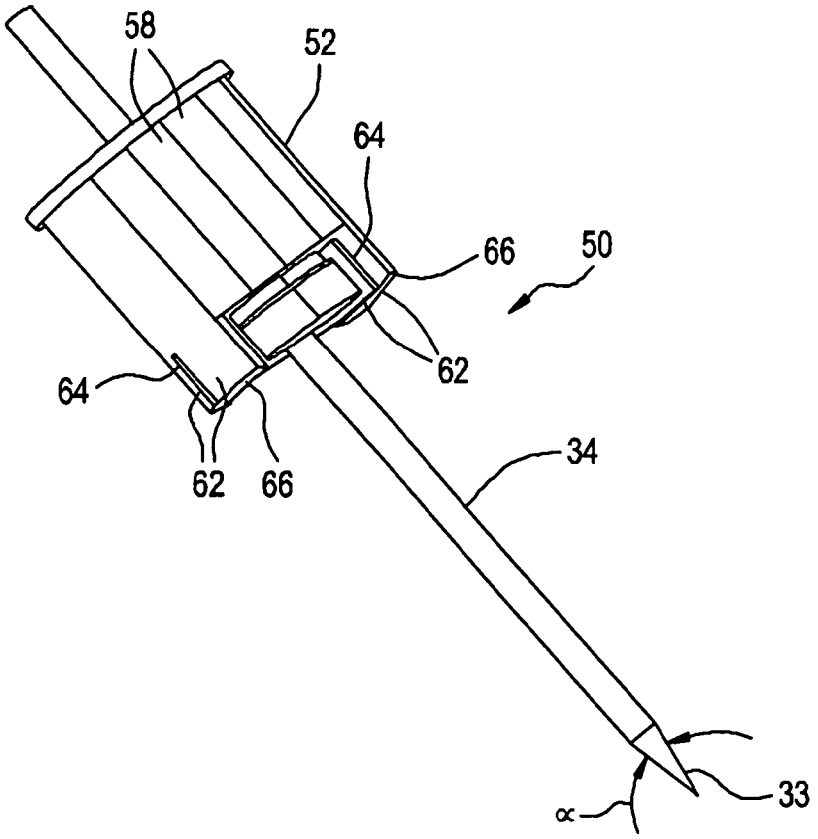
FIG. 9 is a perspective view of the needle assembly of the needle cartridge of FIG. 7.
Figure 10:
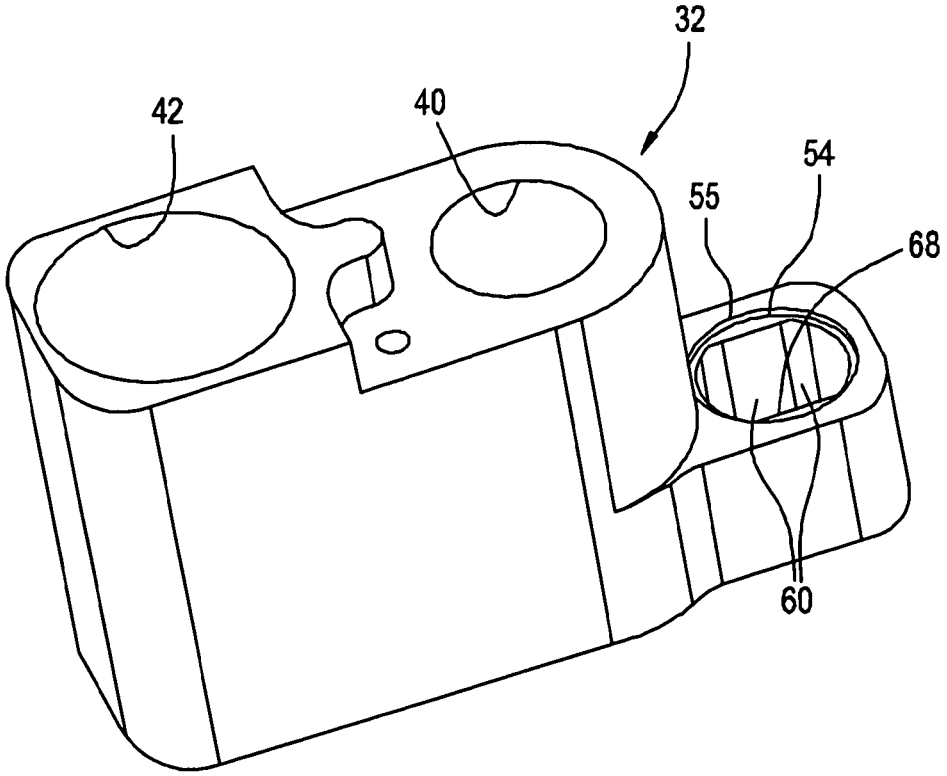
FIG. 10 is a perspective view of the manifold of the apparatus of FIG. 1 prior to connecting the IR sensor, laser optic assembly and needle cartridge thereto.

As shown in FIGS. 6 through 9, the needle 34 is provided in the form of a needle cartridge 50 including a needle mount 52 fixedly secured to the needle 34 for mounting the needle cartridge within a needle-mounting hole 54 of the manifold 32. A needle cover 56 is releasably connectable on one end to the needle mount 52 to cover the sharp tip of the needle during transport, installation and/or removal of the needle. The cover 56 forms a "snap fit" with the needle mount 52 in a manner known to those of ordinary skill in the pertinent art. The needle mount 52 defines a plurality of first flats 58 that cooperate with corresponding second flats 60 formed within the needle mounting aperture 54 of the manifold 32 (see FIG. 10) to fix the angular position of the needle on the manifold and otherwise prevent the needle from rotating relative to the manifold. The needle mount 52 includes a plurality of flexible connecting portions 62 defining axially-extending slots 64 therebetween. The connecting portions 62 include radially-extending flanges 66 on the lower ends thereof. As shown in FIG. 6, the needle cartridge 50 is installed on the manifold 32 by inserting the needle cover 56 into the needle mounting aperture 54 until the needle mount 52 is received within the needle mounting aperture, as shown in FIG. 7. As can be seen, the first flats 58 of the needle mount 52 are angularly aligned with the second flats 60 of the needle mounting aperture upon inserting the needle mount into the aperture. In addition, the needle-mounting aperture 54 defines a chamfer 55 on its upper edge to facilitate insertion of the needle mount 52 therein. When the needle mount 52 is inserted in the needle mounting aperture 54, the radially-extending flanges 66 of the flexible connecting portions 62 flex radially against the inner surfaces of the mounting aperture. Then, when the needle mount 52 is fully inserted, the radially-extending flanges are biased outwardly beneath the lip 68 formed at the base of the mounting aperture 54 (FIG. 10) to fixedly secure the needle with the manifold and otherwise prevent the needle from being forced out of the manifold during penetration or withdrawal of the needle from the resealable stoppers. Preferably, the needle mount snaps into place when located in the fully inserted position to provide an audible and/or tactile indication to the operator that the needle is properly seated within the manifold. Once the needle is installed in the manifold, as shown in FIG. 7, the cover 56 is pulled downwardly and removed to expose the needle for use. To remove and/or replace the needle, the cover is placed back over the needle as shown in FIG. 7, and a sufficient upward axial force is applied to the needle to force the needle mount through the needle mounting aperture. In one embodiment of the present invention, the needles are provided in sterile packs including predetermined lengths of fluid tubing 35 connected thereto. In the embodiment of the present invention wherein the manifold includes a single needle, the needles may be provided in single-needle sterile packs, wherein each sterile package includes a single needle cartridge and predetermined length of tubing connected thereto. However, in embodiments of the present invention wherein a plurality of needles may be mounted on the manifold, each sterile pack may includes the a predetermined number of needle cartridges with tubing connected thereto that is the same as the number of needles that can be mounted on the manifold.

In the currently preferred embodiment, a typical needle 34 defines a conically-pointed, non-coring tip (i.e., a "pencil point" tip) 33, wherein the included angle "a" of the tip in cross-section is within the range of about 15° to about 25°, preferably about 18° to about 22°, and most preferably about 20°. The smooth, sharply-pointed, gradually increasing angle of the needle tip allows for a relatively smooth, and gradual expansion of the needle hole upon penetrating the stopper. The needle tip further defines two axially oblong flow apertures (not shown) on opposite sides of the needle relative to each other. In the currently preferred embodiment, the needle is about 15 gauge (i.e., 0.072 inch diameter). However, as may be recognized by those of ordinary skill in the pertinent art based on the teachings herein, this dimension is only exemplary and may be changed as desired or otherwise required by an application.

Preferably, the needle/stopper interface is treated to reduce the degree of friction therebetween to further reduce the formation of particles during the needle stroke. In one embodiment, the needle is tungsten carbide carbon coated. In another embodiment, the needle is electro-polished stainless steel. In another embodiment, the needle is Teflon coated (although this embodiment gave rise to greater friction forces at the needle/stopper interface than did the tungsten carbide carbon coated embodiment). In yet another embodiment, the needle is titanium coated to reduce friction at the needle/stopper interface. Further, in some embodiments, the depth of stroke of the needle is set to further reduce the formation of particles. In one such embodiment, at the bottom of the needle stroke, the needle flow apertures are spaced below the bottom wall of the stopper and adjacent or contiguous thereto (i.e., the upstream end of each hole is adjacent to the inside surface of the bottom wall of the stopper). In one such embodiment, the needle tip penetrates beyond the inside surface of the bottom wall of the stopper to a depth within the range of about 1 to about 5 cm, preferably within the range of about 1 to about 3 cm, and most preferably about 1.5 centimeters.

Figure 2:
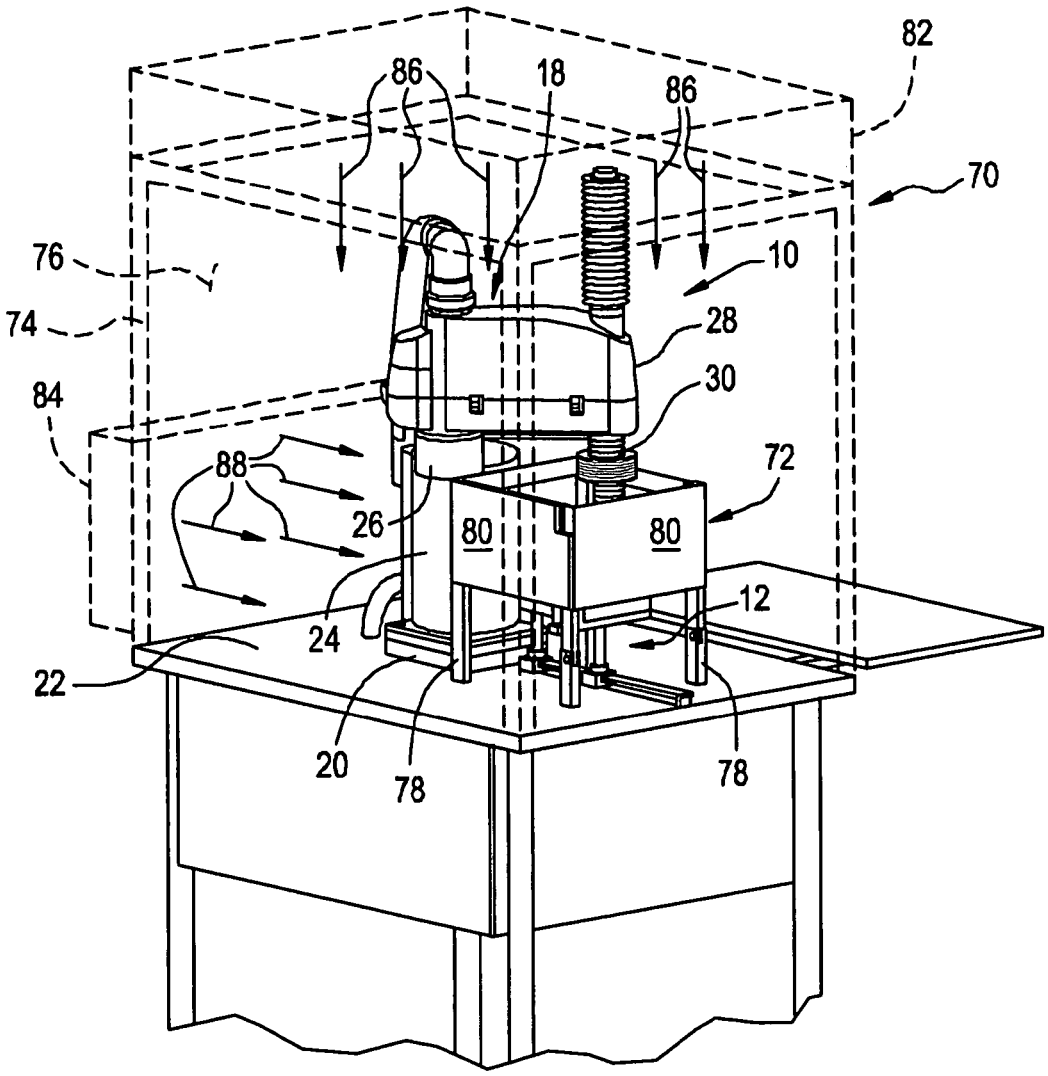
FIG. 2 is a perspective view of the apparatus FIG. 1 illustrating the vial and tray assembly located in the filling and laser resealing position within the needle filling and laser resealing station of the apparatus.

As shown in broken lines in FIG. 2, the apparatus 10 further includes a first or outer barrier enclosure 70 that restricts movement into and out of the filling machine apparatus, and a second or inner barrier enclosure 72 that surrounds the needle filling and laser resealing station of the apparatus. In this embodiment, the first barrier enclosure 70 includes a frame 74 and walls 76 (or panels) supported thereby. One or more of the walls 76 may be transparent, or at least somewhat transparent, to provide visibility into the filling machine. The second barrier enclosure 72 includes a frame 78 and walls (or panels) 80 supported thereby. Preferably, the panels 80 are adapted to limit the transmissibility of particular wavelengths (i.e., the wavelength transmitted by the laser optic assembly), so as to reduce the possibility that emissions from any laser within the filling machine could accidentally cause harm to people in the vicinity of the filling machine. This may be carried out, for example, by tinting. In the illustrated embodiment, the panels are formed of a material sold under the trademark Kentek™ that blocks the radiation transmitted by the laser source. As can be seen, each radiation filtration panel extends vertically adjacent to the manifold 32 from a lower point immediately above the top surfaces of the vials or other containers 14 to permit the vials to be passed beneath the panels for loading and unloading the vials into and out of the needle filling and laser resealing station, to an upper points such that the panels extend vertically a distance sufficient to block, or substantially block all radiation that otherwise would fall within the visual path of an operator or other person looking into the enclosure.

If desired, the first barrier enclosure 70 may includes a plurality of apertures (not shown) in an infeed area spaced relative to each other throughout the respective panel of the barrier in order to allow laterally or horizontally directed laminar flow to exit the aseptic enclosure of the infeed area therethrough. In order to create such laminar flow, the apparatus 10 preferably includes one or more blower 82 and/or 84, as illustrated in broken lines in FIG. 2. The first blower assembly 82 is mounted above the needle filling and laser resealing station to direct a laminar flow of gas downwardly over the vials or other containers during needle filling and laser resealing thereof, as indicated by the vertically flowing arrows 86 in FIG. 2. Alternatively, the second blower assembly 84 is mounted to one side of the needle filling and laser resealing station to direct a laminar flow of gas substantially horizontally over the vials or other containers during needle filling and laser resealing thereof, as indicated by the horizontally flowing arrows 88 in FIG. 2. Each blower assembly includes a filter and a fan to produce a filtered airflow into the filling machine. This filtered airflow causes the air pressure within the barrier 70 to be somewhat greater than the air pressure outside the barrier. This pressure differential helps minimize the possibility of airflow into the filling machine 10, which in turn helps prevent (or at least limit) the possibility that contaminants will get into the filling machine 10. In some embodiments, the filter is a high efficiency filter such as, for example, a HEPA filter.

The base 22 and the barriers 70 and 72 are shaped and dimensioned so as to define clearances therebetween. These clearances, or vents, define a flow path through which the filtered airflow provided by the blower assembly exits the filling machine 10. The barriers, blower assemblies, vents, and structures located within the barrier are preferably designed so as to help ensure that the filtered airflow has laminar flow characteristics, or at least generally laminar flow characteristics (as opposed to turbulent flow characteristics), until exiting the filling machine. The laminar flow characteristics help keep contaminants from entering the filling machine through the vents and help clear out any dust or contaminants that happen to get into the filling machine, and thereby help maintain a "clean" environment within the filling machine.

Figure 3:
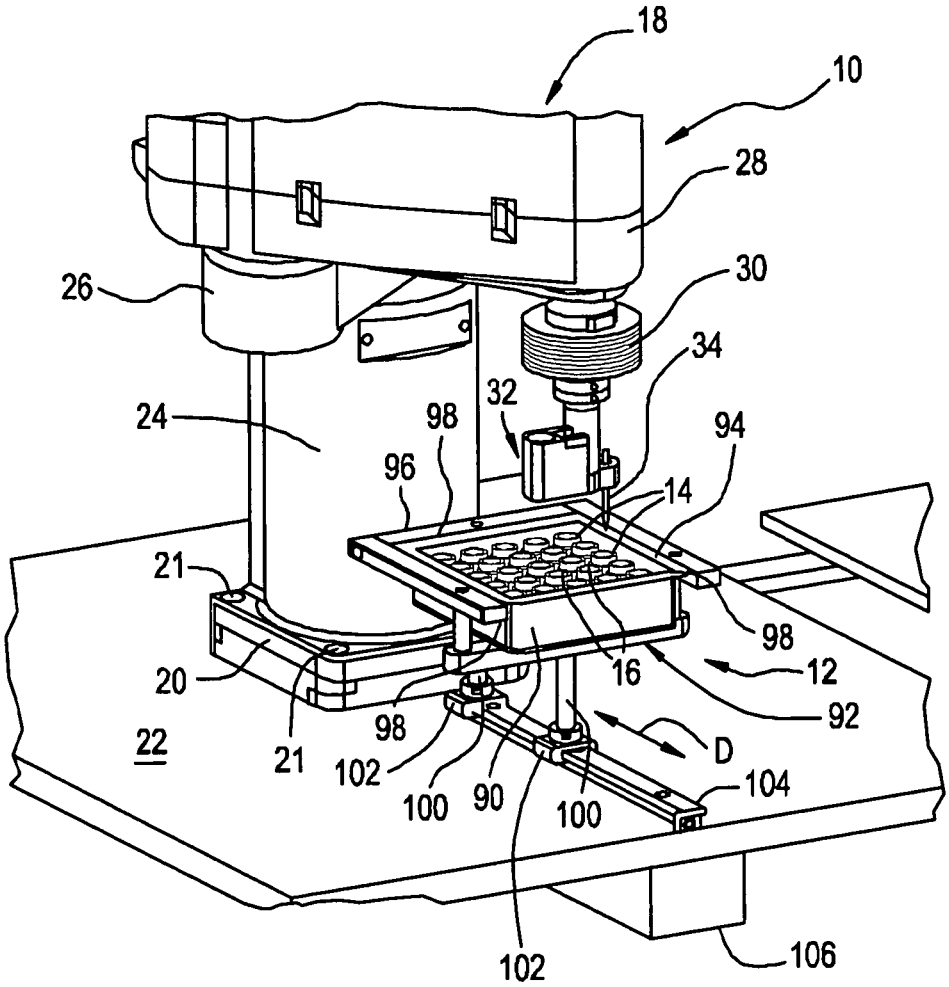
FIG. 3 is partial, perspective view of the apparatus of FIG. 1 with some parts removed for clarity.
Figure 4:
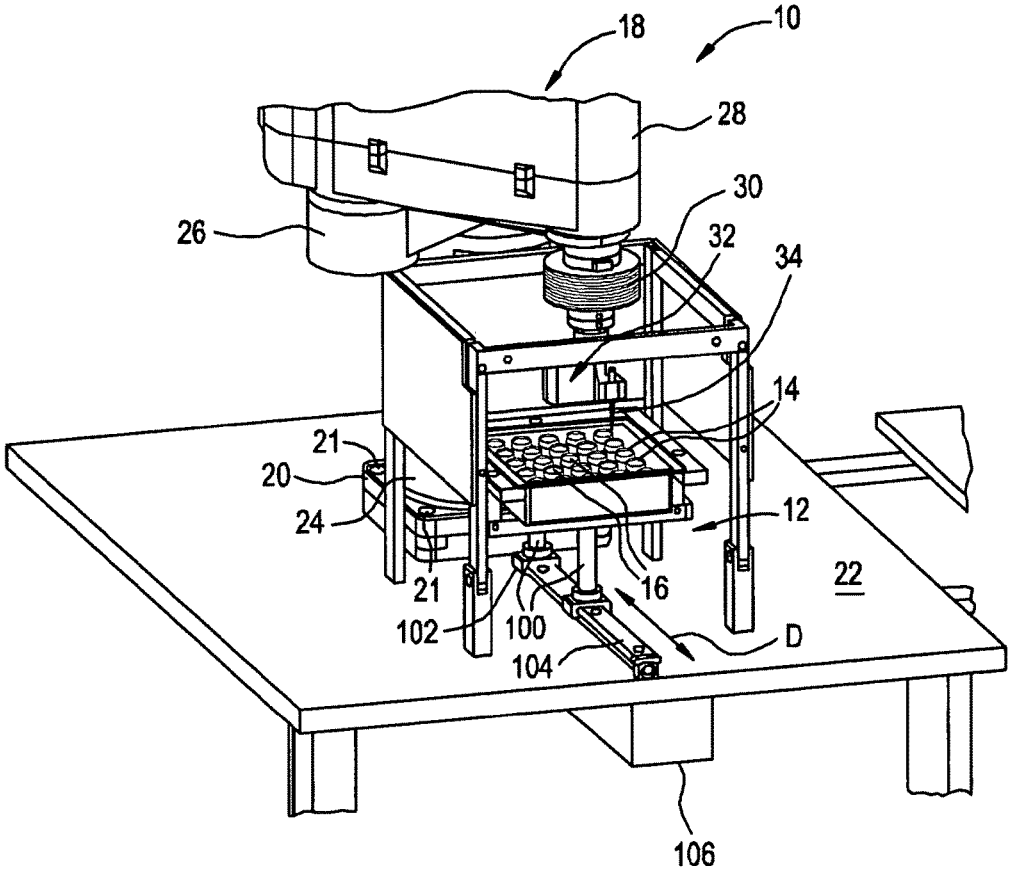
FIG. 4 is another partial, perspective view of the apparatus of FIG. 1 with some parts removed for clarity.

As shown in FIG. 1, the container support 12 includes a tray assembly 90 and a tray support 92. The tray assembly 90 holds a plurality of vials 14 in a matrix defining a plurality of rows and columns such that each vial is precisely positioned within the matrix. The tray support 92 supports that tray 90 and vials thereon within the needle filling and laser resealing station of the apparatus and is movable into and out of the station in the direction indicated by the arrow "D" between a first position for loading the tray of vials thereon (FIG. 1), and a second position for needle filling and laser resealing the vials (FIGS. 2 and 3). The tray 90 includes a peripheral flange 94 that may be grasped to manipulate the tray. The tray support 92 includes a tray support frame 96 that extends about three sides of the tray 90, and defines an inner, peripheral recess 98 for slidably receiving therein the peripheral flange 94 of the tray and preventing relative movement of the and tray support when located in the second position. The support frame 96 includes a pair of spaced upstanding supports 100 connected to substantially opposite sides of the underside of the frame 96 relative to each other. Each upstanding support 100 is drivingly connected through a respective linear bearing assembly 102 to a linear guide 104 fixedly secured to the support surface 22. As can be seen, the tray support 92 is movable on the linear guide 104 in the direction of the arrow D between the first and second positions. A drive unit 106 is mounted to the underside of the support table 22 and is drivingly connected to the tray support 92 to drive the tray support between the first and second positions (and/or other positions if so desired). In one embodiment, the drive unit is a lead screw driven by an electric motor. In another embodiment, the drive unit is a drive belt, such as a toothed belt, driven by an electric motor. In yet another embodiment, the drive unit is a linear actuator, such as a solenoid or pneumatic actuator. As may be recognized by those of ordinary skill in the pertinent art based on the teachings herein, the drive unit may take the form of any of numerous different drive devices that are currently or later become known for performing the function of the drive unit as described herein. Alternatively, the apparatus may not include a drive unit, and the tray support and tray may be moved manually between the first and second positions.

Figure 13:
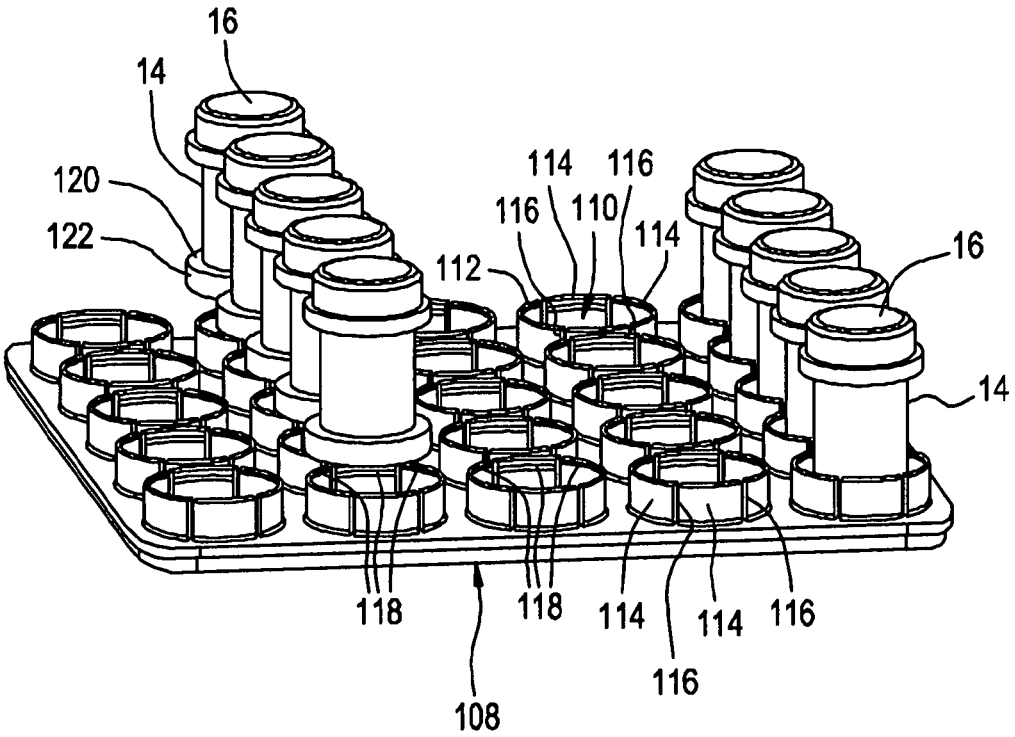
FIG. 13 is a perspective view of the vial support of FIG. 12 and illustrating the manner in which the vials are mounted thereto.
Figure 14:
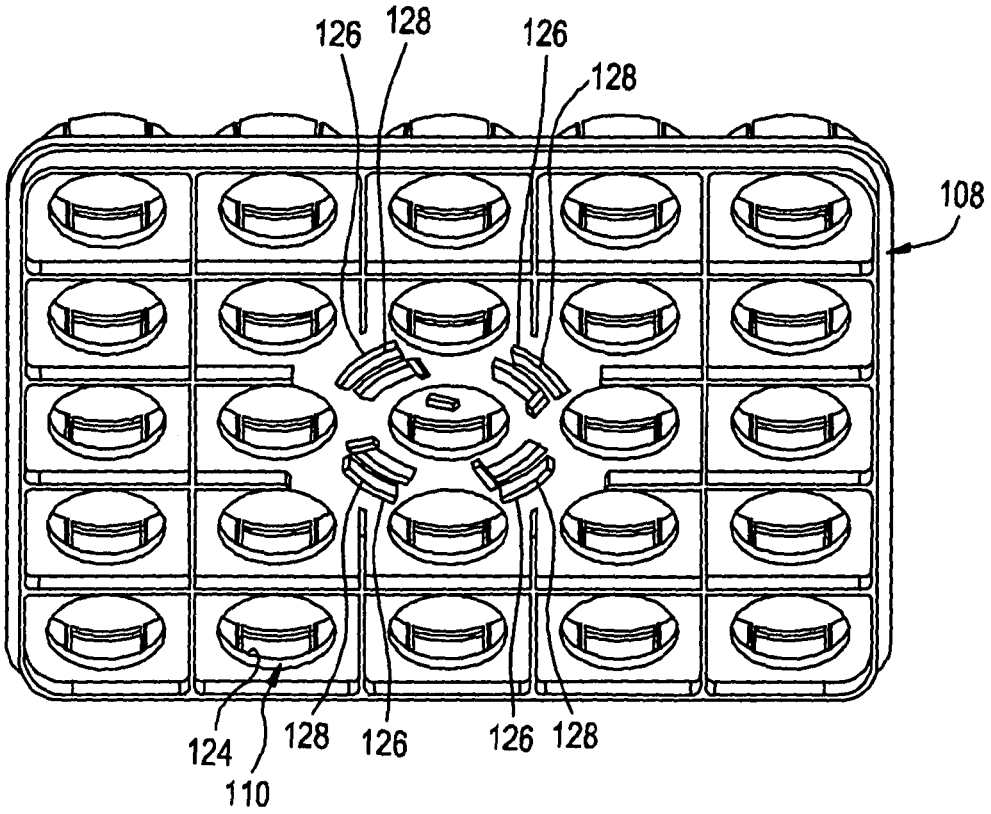
FIG. 14 is an underside perspective view of the vial support of FIG. 13.
Figure 15:
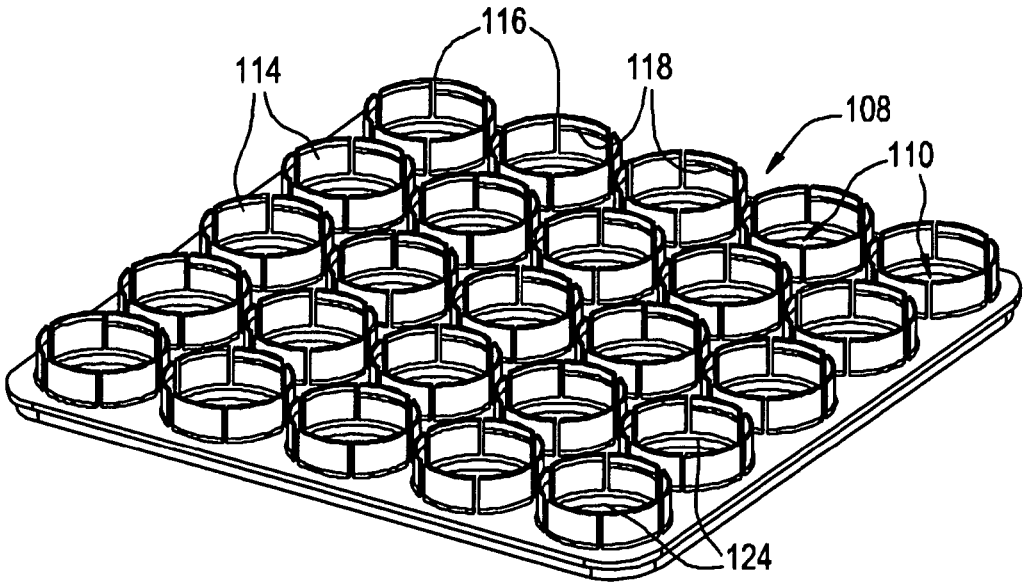
FIG. 15 is a top side perspective view of the vial support of FIG. 14.

As shown in FIGS. 11-16, the tray 90 includes a vial support 108 that is received within the base of the tray for supporting the plurality of vials or other containers thereon. The vial support 108 includes a plurality of apertures 110 and container connectors 112 extending about the upper periphery of each aperture 110. Each container connector includes a plurality of upstanding connecting members 114 that extend about, and conform to the periphery of the respective aperture 110 and define axially extending slots 116 therebetween. Each connecting member includes an inner, radially extending flange 118 that engages the upper edge 120 of the base 122 of a respective vial or other container to releasably secure the vial to the vial support 108. As indicated in FIG. 13, each vial is seated within, and connected to the vial support by inserting the base 122 of the vial into the respective aperture 110. The connecting members 114 are flexible radially outwardly upon engaging the base 122 of the vial to allow the base to pass through the connecting members and to be fully received within the respective aperture 110. As shown in FIG. 14, the vial support defines a peripheral lip 124 formed at the base of each aperture 110 to seat the base 122 of the vial thereon. Each radially extending flange 118 of the connecting members defines an upper tapered or chamfered surface to permit the base 122 of the respective vial to slide over the upper surface and, in turn, flex the respective connecting member 114 radially outwardly. Then, when the base 122 of the vial is fully received within the aperture 110 and seated against the respective lip 124, the underside of each flange 118 engages the upper edge 120 of the respective vial to releasably secure the vial to the vial support and prevent any movement of the vial during needle filling and laser resealing thereof. In order to remove the vials from the vial support, the vials can be tilted or rocked laterally to, in turn, release the base portions 122 from the connecting members.

Figure 16:
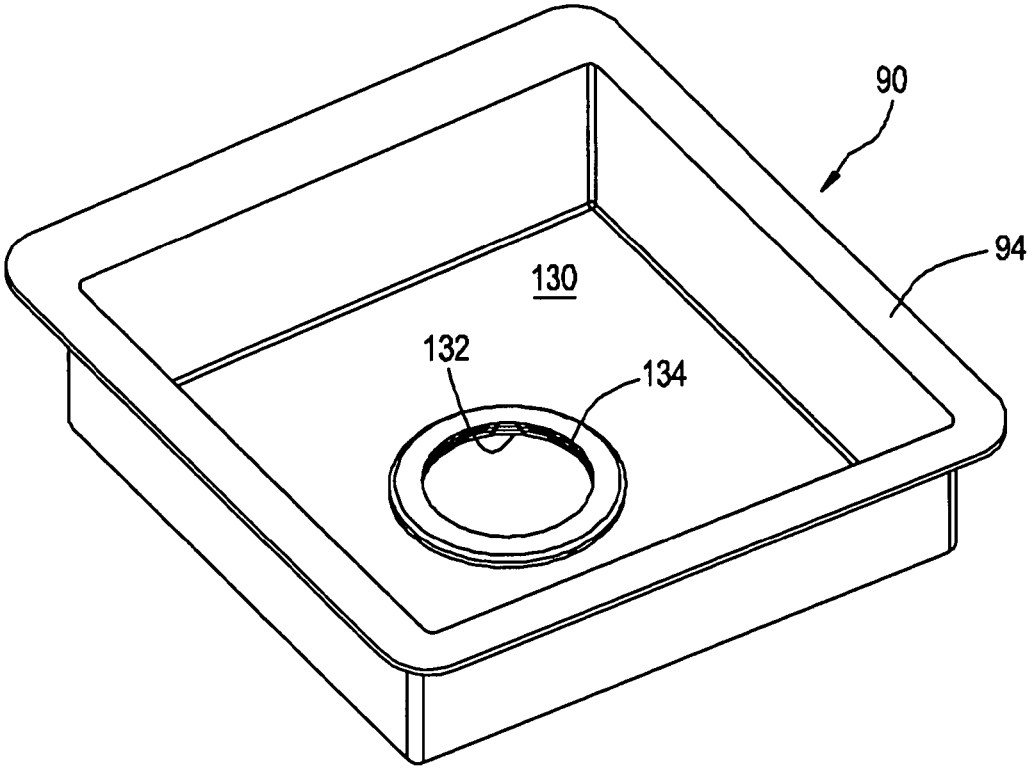
FIG. 16 is an upper perspective view of the tray of FIG. 12.

As shown in FIG. 14, the vial support 108 includes a plurality of downwardly extending, second connecting members 126 that are angularly spaced relative to each other, and each second connecting member 126 defines an outer, radially extending connecting flange 128 for connecting the vial support to the tray. As shown in FIG. 16, the tray 90 defines a bottom wall 130 thereof a connecting aperture 132 for receiving therethrough the second connecting members 126. The connecting aperture 132 defines an upper, peripheral chamfered surface 134 that slidably engages the radially extending connecting flanges 128 of the connected members 126 upon inserting the connecting members through the connecting aperture to, in turn, flex the connecting members radially inwardly. Then, when the second connecting members 126 are fully inserted into the connecting aperture 124, the connecting flanges 128 engage the underside of the peripheral surface 134 of the tray to prevent upward movement of the vial support and thereby releasably connect the vial support to the tray.

Figure 11:
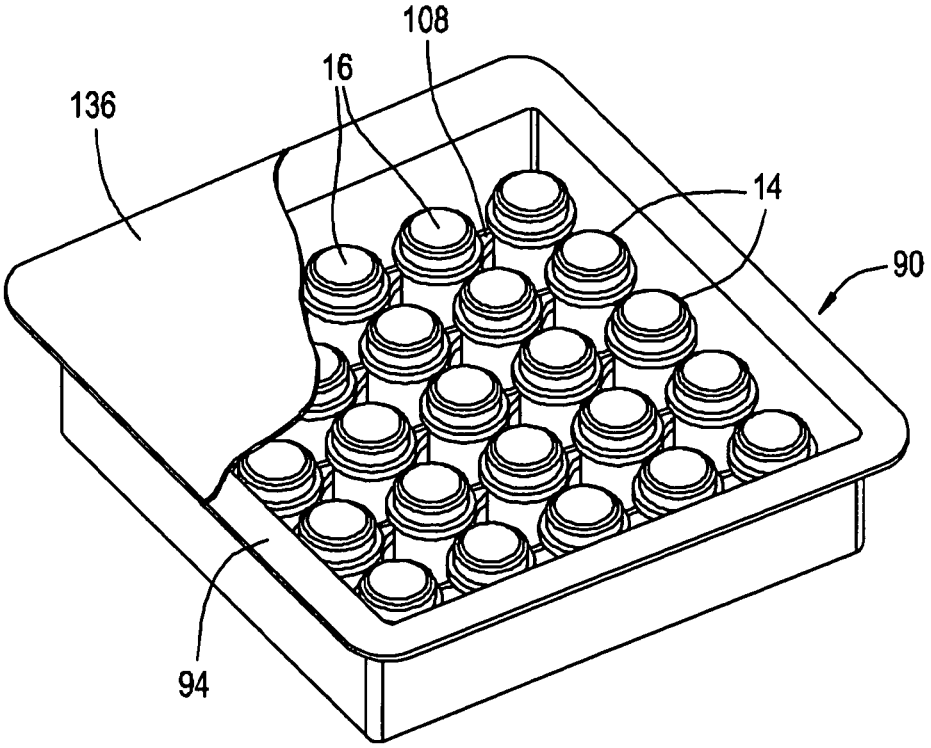
FIG. 11 is a perspective view of the vial and tray assembly used in connection with the apparatus of FIG. 1 and showing partially the Tyvek or like cover for sealing the vials within the tray.
Figure 12:
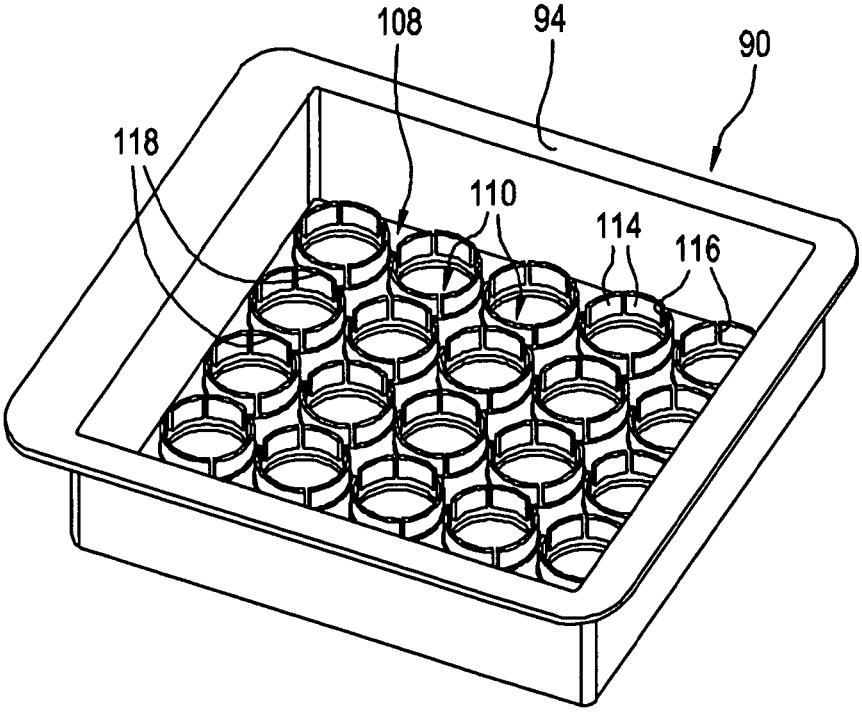
FIG. 12 is a perspective view of the tray and vial support assembly prior to mounting the vials thereto.

The empty, sealed vials 14 are mounted within the trays 90 as shown typically in FIG. 11, and then a cover 136, as shown partially in FIG. 11, is sealed to the flange 94 by, for example, a pressure sensitive adhesive, such that the cover extends over the vials and is sealed about the periphery of the tray to the flange to seal the vials within the tray and cover the enclosure. In one embodiment, the cover is formed of Tyvek™, and the Tyvek enclosed tray(s) is sealed within a double bag enclosure. The Tyvek enclosed trays then may be gamma sterilized, or otherwise sterilized to, in turn, sterilize the empty, sealed vials mounted thereon. Alternatively, the empty, sealed vials may be sterilized prior to mounting and sealing them within the trays. As my be recognized by those of ordinary skill in the pertinent art based on the teachings herein, the Tyvek material is only exemplary, and other materials that are currently, or later become known equally may be employed. To expose the vials within the tray, the cover may be peeled away manually, or if desired, the apparatus may includes a cover-removing surface that engages the cover upon loading the tray into the apparatus and that peels away, or otherwise removes the cover as the tray is moved inwardly. Alternatively, the robot 18, or another robot can be programmed and manipulated to remove the cover once mounted within the enclosure.

As may be recognized by those of ordinary skill in the pertinent art based on the teachings herein, the vial and tray assemblies may be enclosed, sterilized, and transported in accordance with the teachings of the present inventor's commonly owned U.S. Pat. No. 5,186,772, entitled "Method Of Transferring Articles, Transfer Pocket And Enclosure", and/or U.S. patent application Ser. No. 10/421,249, entitled "Transfer Port and Method For Transferring Sterile Items", filed Sep. 10, 2002, each of which is hereby expressly incorporated by reference as part of the present disclosure. The tray and vial assemblies are placed in an internal bag or "pocket" which is closed and, if desired, provided with a sterilization indicator. Then, the internal pocket is placed within a transfer pocket including a sealing frame defining an annular groove on a peripheral surface thereof. The transfer pocket is stretched over the surface of the frame and closed by an elastic band overlying the transfer pocket and received within the peripheral groove. The transfer pocket likewise may include therein a sterilization indicator. Preferably, the assembled transfer and internal pockets are sealed within an "external" pocket and the assembled pockets are subject to sterilization, such as by exposure to gamma radiation, to sterilize the pockets and the empty vial and tray assemblies within the pockets. The transfer pockets can then be used to store and/or transport the sterilized assemblies to a filling apparatus without contaminating the sterilized assemblies.

The empty vial and tray assemblies are introduced into the aseptic enclosure by removing and discarding the external pocket, and connecting the sealing frame of the transfer pocket to a window or transfer port mounted in a side wall of the enclosure. As further disclosed in the above-mentioned patent and patent application, an adhesive material is preferably superimposed on the sealing frame for securing the transfer pocket to the transfer port of the enclosure. Prior to releasing the tray and vial assemblies into the enclosure, the sterilization indicators are preferably checked in order to ensure that the sterile condition of the vial and tray assemblies were maintained throughout storage and transfer. As described in the above-mentioned patent and patent application, the portion of the transfer pocket overlying the frame is then cut away and simultaneously sterilized along the trimmed surfaces to destroy any microorganisms or germs thereon, and to allow the internal pocket to be received through the transfer port and into the enclosure. Once received within the enclosure, the internal pocket is opened and the empty vial and tray assemblies are removed and loaded into the needle filling and laser resealing station.

In some embodiments, once loaded onto the filling machine 10, the vials or other containers (or at least the needle penetration surfaces thereof) are sterilized again by laser radiation, or by e-beam radiation, in order to further ensure absolute sterility of the requisite surfaces prior to filling and sealing. For example, in some embodiments, the filling machine may further include an e-beam assembly comprising an e-beam source as disclosed in U.S. patent application Ser. No. 10/600,525, filed Jun. 19, 2003, or international PCT Patent Application No. PCT/US03/19656, filed Jun. 19, 2003, each of which is entitled "STERILE FILLING MACHINE HAVING NEEDLE FILLING STATION WITHIN E-BEAM CHAMBER" and is hereby expressly incorporated by reference as part of the present disclosure.

As described in these patent applications, the e-beam source may be any of numerous different types of e-beam sources that are currently, or later become known, for performing the function of the e-beam source described herein. E-beam radiation is a form of ionizing energy that is generally characterized by its low penetration and high dose rates. The electrons alter various chemical and molecular bonds upon contact with an exposed product, including the reproductive cells of microorganisms, and therefore e-beam radiation is particularly suitable for sterilizing vials, syringes and other containers for medicaments or other sterile substances. An e-beam source produces an electron beam that is formed by a concentrated, highly charged stream of electrons generated by the acceleration and conversion of electricity. Preferably, the electron beam is focused onto a penetrable surface of each container for piercing by a needle to thereby fill the container with a medicament or other substance. For example, in the case of vials, such as the vials including resealable stoppers as described above, the electron beam is focused onto the upper surface of the stopper to sterilize the penetrable surface of the stopper prior to insertion of the filling needle therethrough, and further, is preferably directed onto at least the surfaces of the needle that contact the stopper to further ensure sterilization of such surfaces. In addition, reflective surfaces may be appropriately positioned about the needle filling and laser resealing to reflect the e-beam, and/or the reflected and scattered electrons onto the desired surfaces of the vial and needle, or to otherwise create an e-beam shower or cloud within which the desired surfaces will be sterilized by the e-beam radiation. Alternatively, or in combination with such reflective surfaces, more than one e-beam source may be employed, wherein each e-beam source is focused onto a respective surface or surface portion of the vials or other containers and/or needle to ensure sterilization of each surface area of interest.

In some embodiments the current, scan width, position and energy of the e-beam, the speed of the transport system, and/or the orientation and position of any reflective surfaces, are selected to achieve at least about a 3 log reduction, and preferably about a 6 log reduction in bio-burden testing on the upper surface of the vial's resealable stopper, i.e., the surface of the stopper defining the penetrable region that is pierced by a filling needle to fill the vial, and on the surfaces of the needle that contact the stoppers. In addition, as an added measure of caution, one or more of the foregoing variables also are preferably selected to achieve at least about a 3 log reduction on the sides of the vial, i.e., on the surfaces of the vial that are not pierced by the needle during filling and on other surfaces of the needle that do not contact the stopper. These specific levels of sterility are only exemplary, however, and the sterility levels may be set as desired or otherwise required to validate a particular product under, for example, United States FDA or applicable European standards, such as the applicable Sterility Assurance Levels ("SAL"). An exemplary sterile filling machine including an e-beam unit which is adapted to needle fill within the e-beam chamber is described in the above-mentioned patent application.

In the currently-preferred embodiments, each resealable stopper is formed of a thermoplastic material defining a needle penetration region that is pierceable with a needle to form a needle aperture therethrough, and is heat resealable to hermetically seal the needle aperture by applying laser radiation at a predetermined wavelength and power thereto. Each stopper includes a thermoplastic body defining (i) a predetermined wall thickness in an axial direction thereof, (ii) a predetermined color and opacity that substantially absorbs the laser radiation at the predetermined wavelength and substantially prevents the passage of the radiation through the predetermined wall thickness thereof, and (iii) a predetermined color and opacity that causes the laser radiation at the predetermined wavelength and power to hermetically seal the needle aperture formed in the needle penetration region thereof in a predetermined time period and substantially without burning the needle penetration region and/or the cover portion of the cap (i.e., without creating an irreversible change in molecular structure or chemical properties of the material). In some embodiments, the predetermined time period is approximately 2 seconds, is preferably less than or equal to about 1.5 seconds, and most preferably is less than or equal to about 1 second. In some of these embodiments, the predetermined wavelength of the laser radiation is about 980 nm, and the predetermined power of each laser is preferably less than about 30 Watts, and preferably less than or equal to about 10 Watts, or within the range of about 8 to about 10 Watts. Also in some of these embodiments, the predetermined color of the material is gray, and the predetermined opacity is defined by a dark gray colorant (or pigment) added to the stopper material in an amount within the range of about 0.3% to about 0.6% by weight.

In addition, if desired, a lubricant of a type known to those of ordinary skill in the pertinent art may be added to or included within each of the above-mentioned thermoplastic compounds, in order to prevent or otherwise reduce the formation of particles upon penetrating the needle penetration region of the thermoplastic portion with the needle. In one embodiment, the lubricant is a mineral oil that is added to the styrene block copolymer or other thermoplastic compound in an amount sufficient to prevent, or substantially prevent, the formation of particles upon penetrating same with the needle or other filling member. In another, the lubricant is a silicone, such as the liquid silicone sold by Dow Corning Corporation under the designation "360 Medical Fluid, 350 CST", or a silicone oil, that is added to the styrene block copolymer or other thermoplastic compound in an amount sufficient to prevent, or substantially prevent, the formation of particles upon penetrating same with the needle or other filling member. In one such embodiment, the silicone oil is included in an amount within the range of about 0.4% to about 1% by weight, and preferably within the range of about 0.4 to about 0.6% by weight, and most preferably within the range of about 0.51 or about 0.5% by weight.

As described above, the configuration of the needle that is penetrating the stopper, the friction forces created at the needle/stopper interface, and/or the needle stroke through the stopper also can be controlled to further reduce or substantially prevent the formation of particles upon penetrating the stoppers with the needles.

Also in accordance with a currently preferred embodiment, the needle penetrable and laser resealable stopper comprises: (i) a styrene block copolymer, such as any such styrene block copolymers described above, within the range of about 80% to about 97% by weight (e.g., 95% by weight as described above); (ii) an olefin, such as any of the ethylene alpha-olefins, polyolefins or olefins described above, within the range of about 3% to about 20% by weight (e.g., about 5% as described above); (iii) a pigment or colorant added in an amount sufficient to absorb the laser energy, convert the radiation to heat, and melt the stopper material, preferably to a depth equal to at least about ⅓ to about ½ of the depth of the needle hole, within a time period of less than about 2 seconds, more preferably less than about 1.5 seconds, and most preferably less than about 1 second; and (iv) a lubricant, such as a mineral oil, liquid silicone, or silicone oil as described above, added in an amount sufficient to substantially reduce friction forces at the needle/stopper interface during needle penetration of the stopper to, in turn, substantially prevent particle formation.

Also in accordance with a currently preferred embodiment, in addition controlling one or more of the above-mentioned parameters to reduce and/or eliminate the formation of particles (i.e., including the silicone oil or other lubricant in the thermoplastic compound, and controlling the configuration of the needle, the degree of friction at the needle/stopper interface, and/or the needle stroke through the stopper), the differential elongation of the thermoplastic components of the resealable stopper is selected to reduce and/or eliminate the formation of particles.

Thus, in accordance with such preferred embodiment, the needle penetrable and laser resealable stopper comprises: (i) a first thermoplastic material within the range of about 80% to about 97% be weight and defining a first elongation; (ii) a second thermoplastic material within the range of about 3% to about 20% by weight and defining a second elongation less than the elongation of the first material; (iii) a pigment or colorant added in an amount sufficient to absorb the laser energy, convert the radiation to heat, and melt the stopper material, preferably to a depth equal to at least about ⅓ to about ½ of the depth of the needle hole, within a time period of less than about 2 seconds, more preferably less than about 1.5 seconds, and most preferably less than about 1 second; and (iv) a lubricant, such as a mineral oil, liquid silicone, or silicone oil as described above, added in an amount sufficient to substantially reduce friction forces at the needle/stopper interface during needle penetration of the stopper to, in turn, substantially prevent particle formation.

In accordance with a further aspect, the first material defines a lower melting point (or Vicat softening temperature) than does the second material. In some of the, the first material is a styrene block copolymer, and the second material is an olefin, such as any of a variety of ethylene alpha-olefins or polyolefins. Also in accordance with the currently preferred embodiment, the first material defines an elongation of at least about 75% at 10 lbs force (i.e., the length increases by 70% when subjected to a 10 lb. force), preferably at least about 85%, and most preferably at least about 90%; and the second material defines an elongation of at least about 5% at 10 lbs force, preferably at least about 10%, and most preferably at least about 15%, or within the range of about 15% and about 25%.

In order to needle fill and laser reseal the vials 14, the tray 90 is loaded onto the tray support 96 as illustrated in FIG. 1. At this point, or prior to loading the tray onto the tray support, the Tyvek or other cover is removed to expose the vials within the tray. Then, the tray support is moved from the first or loading position, as shown in FIG. 1, to the second or needle filling and laser resealing position, as shown in FIGS. 2 and 3. Then, the robot 18 is programmed to move the manifold from one vial to the next in a predetermined pattern to insert the needle through the stopper, fill the vial with a predetermined volume or weight of medicament or other substance to be contained therein, withdraw the needle from the filled vial, laser reseal the needle penetrated region of the stopper, and sense the temperature of the sealed surface to ensure that the needle hole is properly sealed. Then, the manifold is moved over the next vial and the process is repeated until all vials are filled and sealed. In the second position, the container support 12 precisely located the vials within the needle filling and laser sealing station so that the robot can precisely position the manifold over each respective vial to perform the needle filling, laser resealing and temperature sensing operations thereon.

In one embodiment, the needle is initially withdrawn at a relatively slow speed to allow the vial to fill "bottom-up"; then, when the vial is filled, the needle is withdrawn at a relatively faster speed to quickly remove the needle and decrease overall cycle time. In another embodiment, the depth of stroke of the needle is set to reduce or prevent the formation of particles. In one such embodiment, at the bottom of the needle stroke, the needle flow apertures are spaced below the bottom wall of the stopper and adjacent or contiguous thereto (i.e., the upstream end of each hole is adjacent to the inside surface of the bottom wall of the stopper). In one such embodiment, the needle tip penetrates beyond the inside surface of the bottom wall of the stopper to a depth within the range of about 1 to about 5 cm, preferably within the range of about 1 to about 3 cm, and most preferably about 1.5 centimeters. At the bottom of the needle stroke, the medicament or other substance is delivered therethrough and into the vial. Then, when the predetermined amount of medicament or other substance is delivered, the needle is withdrawn. Preferably, the needle and/or stopper is treated to reduce friction at least at the needle/stopper interface to, in turn, further prevent the formation of particles. In the latter embodiment, the needles are not withdrawn while filling. Rather, the needle penetrates the stopper a minimum amount as indicated above to allow filling while holding the needle in place, for example, at the bottom of the stroke, and then the needle is withdrawn from the stopper after filling. One advantage of this embodiment is that it reduces the relative movement of the needle and stopper surfaces, and thus facilitates in preventing the formation of particles during needle penetration and withdrawal.

Figure 17:
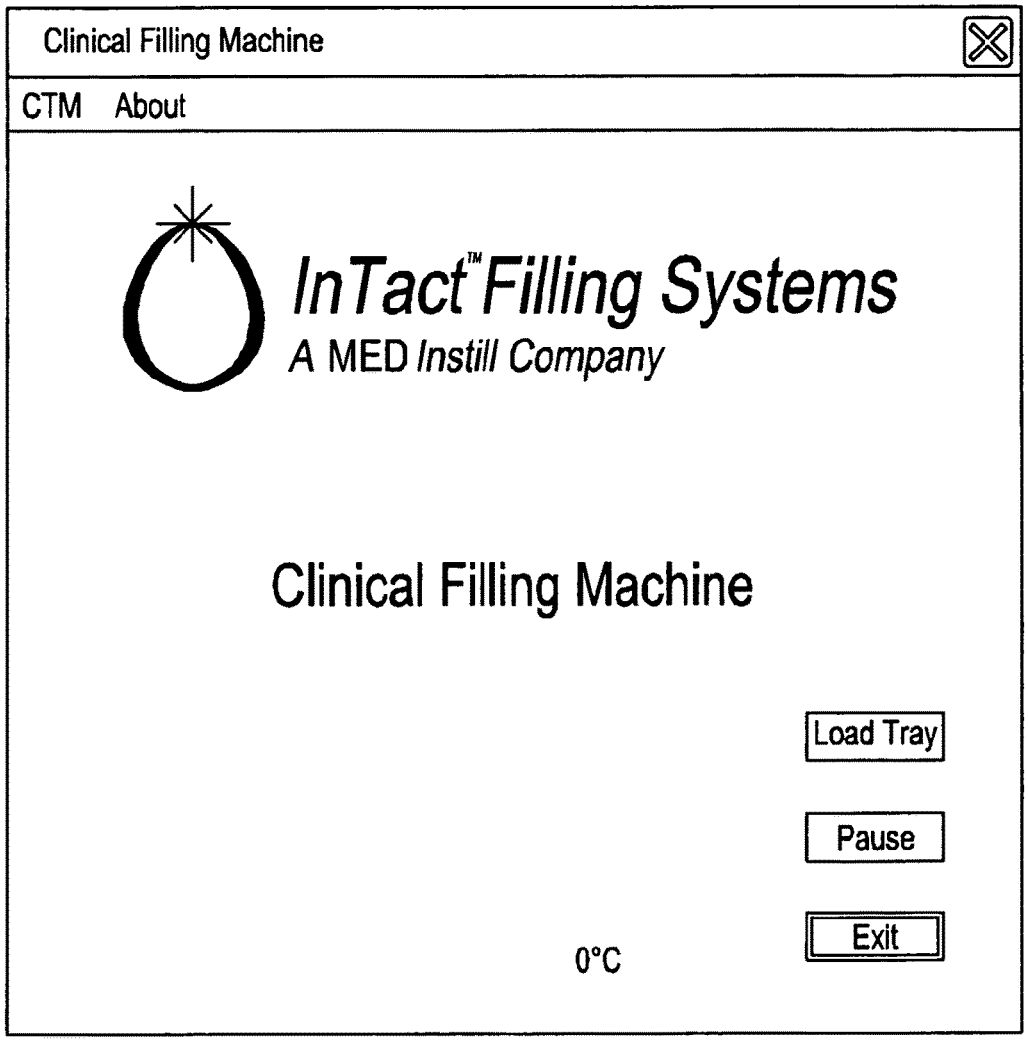
FIGS. 17 through 22 are screen displays of the computer control system for controlling operation of the apparatus of FIG. 1.
Figure 18:
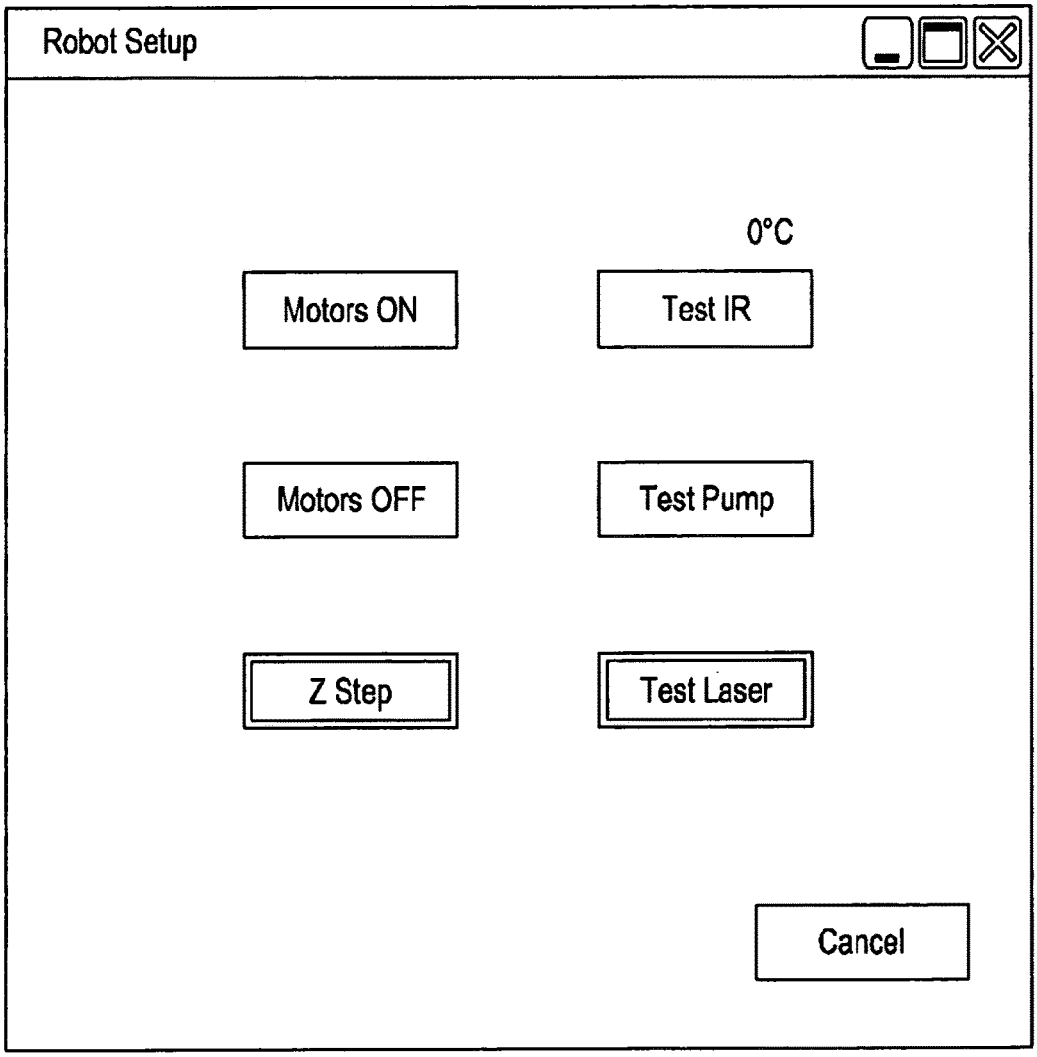
Figure 19:
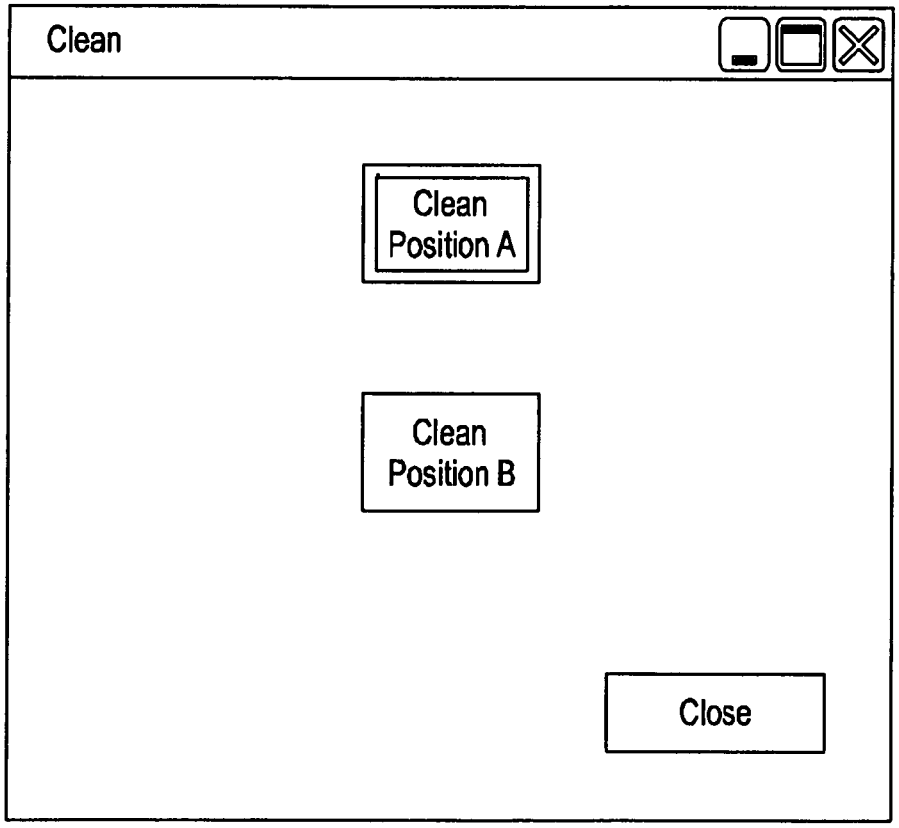
Figure 20:
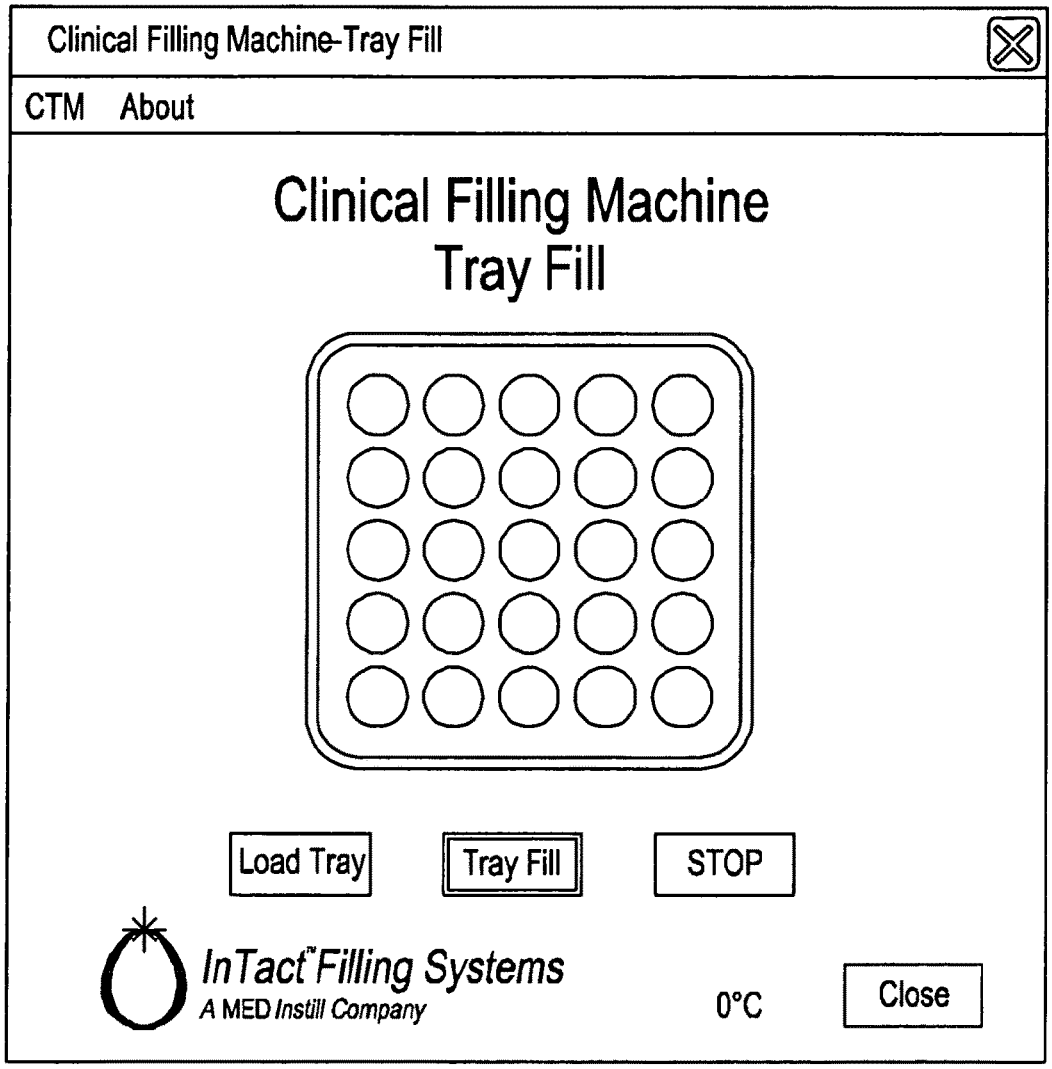
Figure 21:
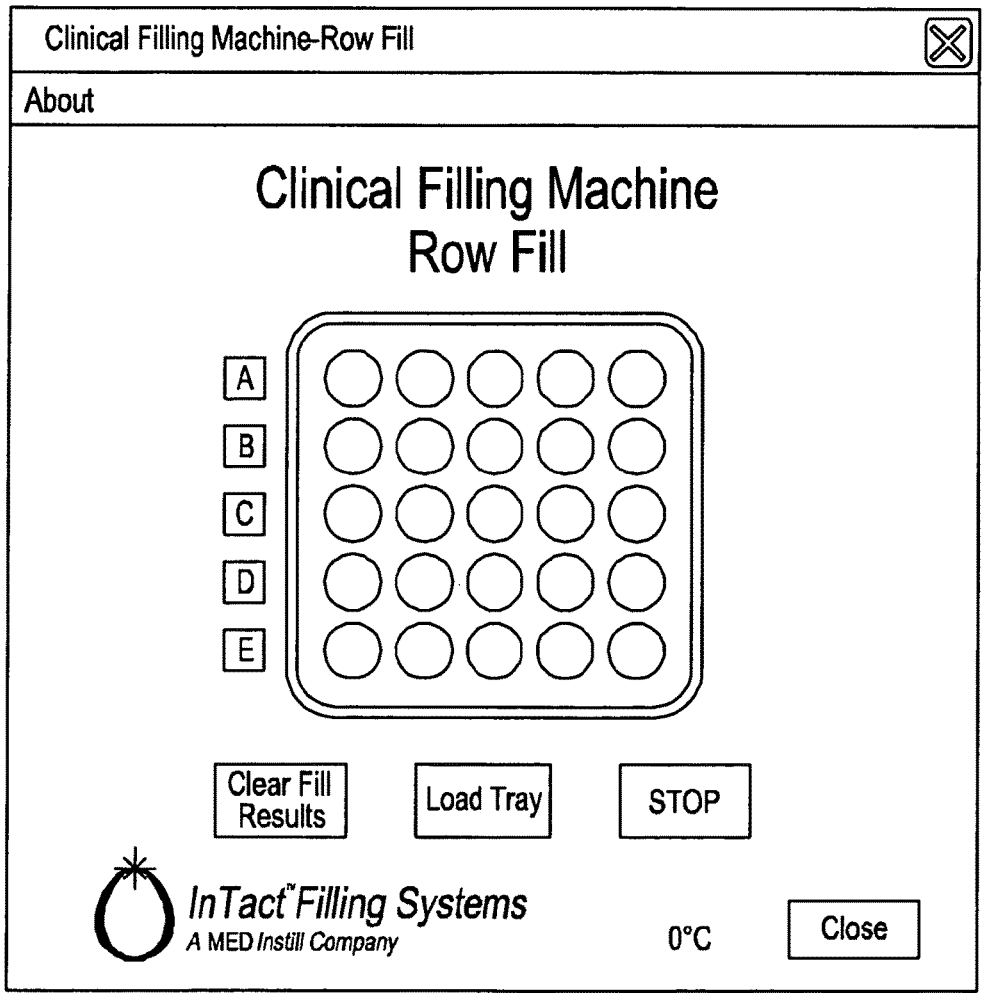
Figure 22:
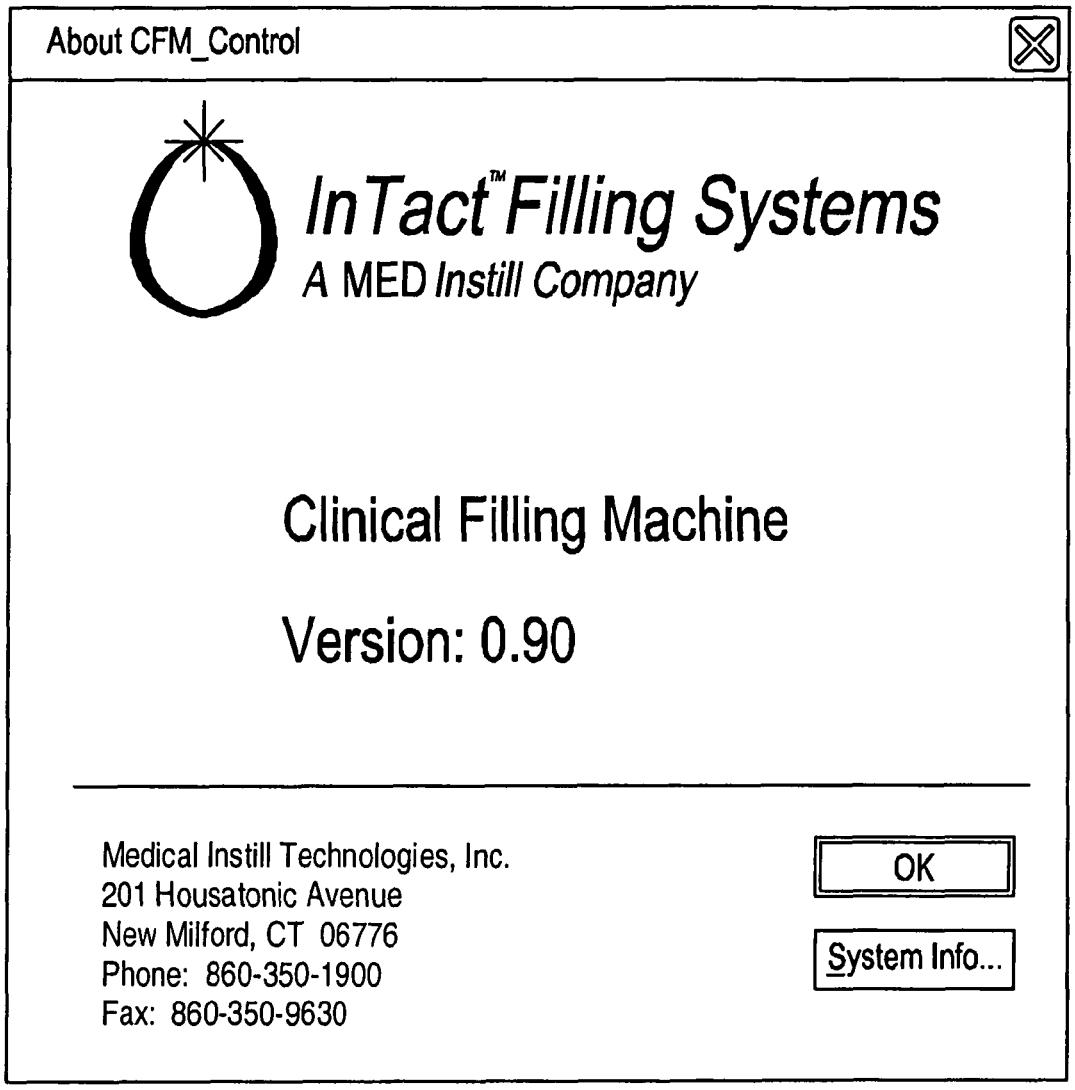
Figure 23:
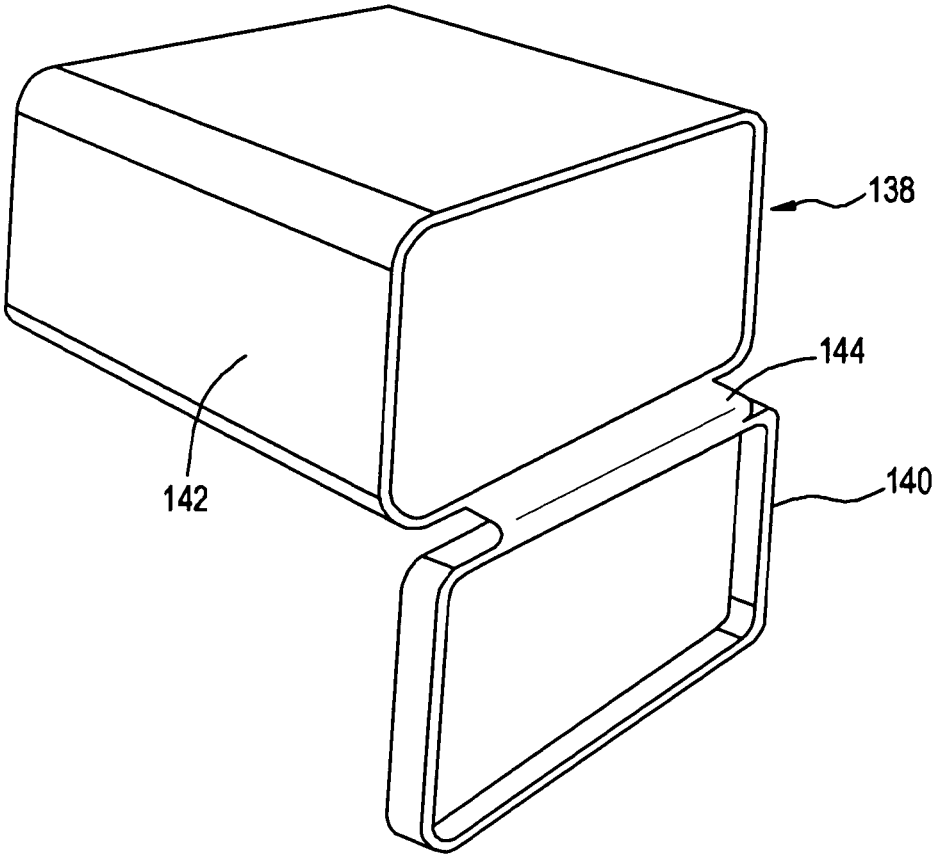
FIG. 23 is a perspective view of a box for storing and transporting the vial and tray assemblies.
Figure 24:
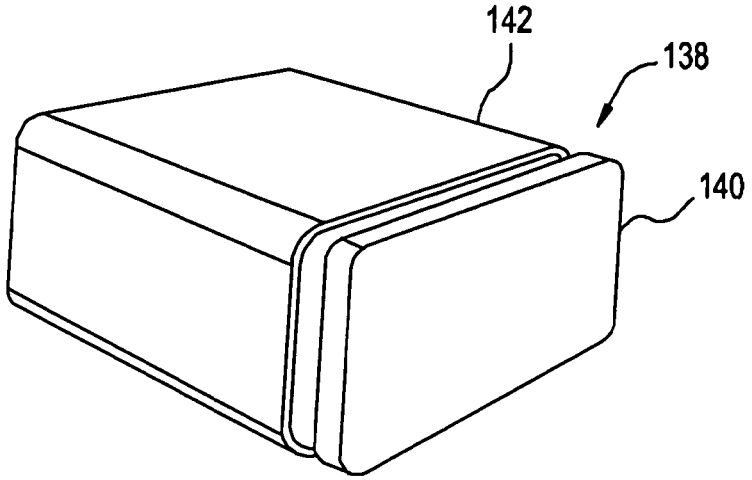
FIG. 24 is a perspective view of the box of FIG. 23 showing the cover closed and an adhesive strip secured to the seam between the cover and box body to seal same.

In FIGS. 17 through 22, various screen displays of the computer 45 (FIG. 6) for controlling operation are the apparatus are illustrated. The "Main" screen illustrated in FIG. 17 provides access to all other screens in menus and an "Exit" button for exiting programs. In the "Robot Setup" screen of FIG. 18, the operator can turn on and off the robot the "Motors On" and "Motors Off" buttons, test the IR sensor through the "Test IR" button, test the z-travel of the robot through the "Z Step" button, test the operation of the peristaltic pump through the "Test Pump" button, and test the operation of the laser through the "Test Laser" button. From the "Clean" screen of FIG. 19, the user can move the robot to two different wash down positions ("Clean Position A" and "Clean Position B"). From the "Tray Fill" screen of FIG. 20, the user can move the robot to the tray loading position, load the tray from the first to the second position, and then fill the vials on the tray by manipulating the "Tray Fill" button. The illustration of the vial and tray assembly on the screen illustrates the filled and sealed vial in a first color (e.g., green) if the vial passes the IR sense (i.e., if the vial was successfully sealed), and illustrates the vial in a second color (e.g., red) if the vial fails the IR sense (i.e., if the vial was not successfully sealed). Thus, the user can identify any vials that are not successfully sealed and discard or otherwise mark such defective vials. If desired, the user can select to fill individual vials by using a mouse or other input device to simply "click" on or otherwise select the illustration on the screen of the respective vial, and thereby control the order within which the vials are filled, and/or control the selection of the vials to be filled. From the "Row Fill" screen of FIG. 21, the user can move the robot to the tray loading position by manipulating the "Load Tray" button, load the tray from the first to the second position, and then fill each row of vials on the tray by manipulating the row buttons (buttons/rows A through E). As with the "Tray Fill" screen, if desired, the user can select to fill individual vials by using a mouse or other input device to simply "click" on or otherwise select the illustration on the screen of the respective vial, and thereby control the order within which the vials are filled, and/or control the selection of the vials to be filled. From the "Control" screen of FIG. 22, the user can open the robot utilities to teach positions, clear an emergency, test I/O functions, etc.

Figure 25:
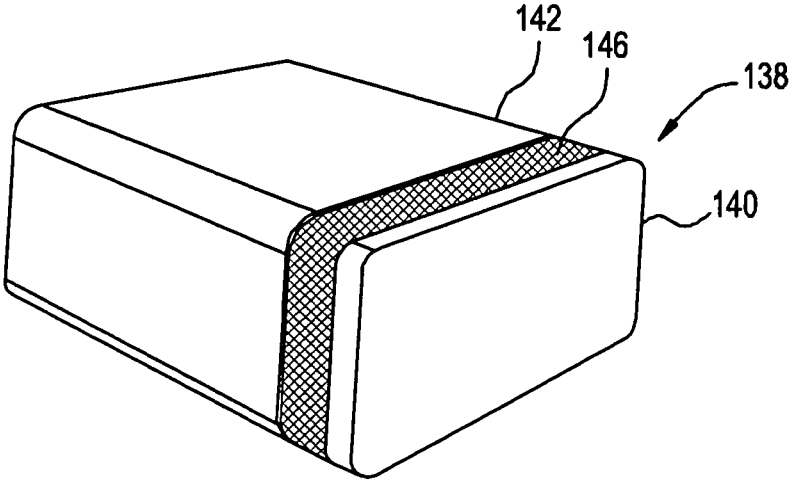
FIG. 25 is a perspective view of the box of FIG. 24 showing the cover spaced from the box body.
Figure 26:
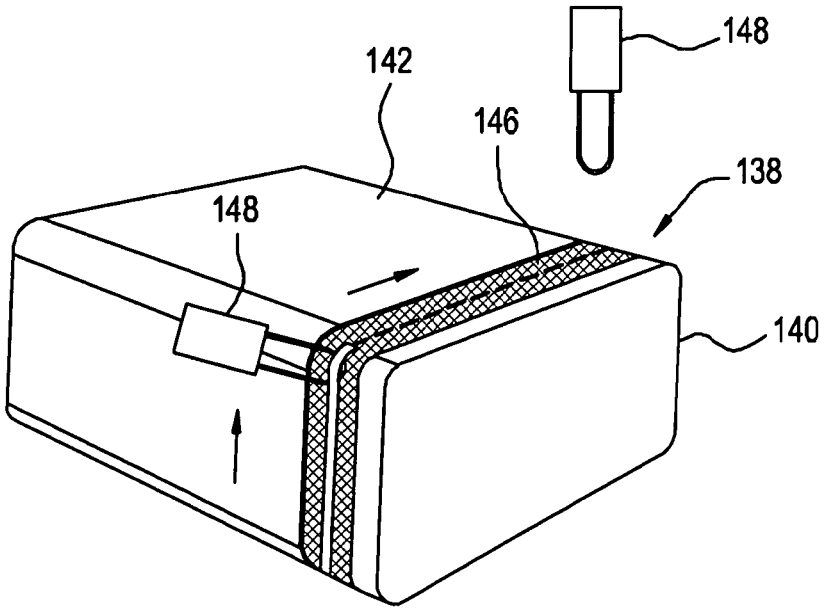
FIG. 26 is another perspective view of the box of FIG. 23 showing in broken lines the manner in which the adhesive strip is cut to open the box and showing the sterilization indicators connected to the box.

In FIGS. 23 through 26, a box-like container for support the sterilized trays of vials is indicated generally by the reference numeral 138. The box 138 may hold one tray and vial assembly, or may hold plural tray and vial assemblies. As with the tray assemblies, the box may be molded of plastic, such as a relatively inexpensive recyclable plastic. The box includes a lid 140 that may be flexible connected to the body 142 of the box by a living hinge 144. If desired, the cover may be formed separate from the box (i.e., without the hinge). The separate cover embodiment may facilitate easier connection to or removal from a sterile transfer port. The tray and vial assemblies (not shown) are mounted within the interior of the body 142 of the box, and the cover is closed to seal the tray and vial assembly within the box. Then, as shown in FIG. 25, an adhesive strip 146, such as a strip of tape of a type known to those of ordinary skill in the pertinent art, is attached over the seam between the cover 140 and body 142 to seal the entire seam and secure the cover to the body. The sealed box then may be subject to gamma radiation or autoclaving to sterilize the empty vial and tray assemblies. The box then may be double bagged as described above for transport and/or storage. The box may be inserted into the aseptic enclosure of the apparatus 10 through a sterile transfer port mounted within a side panel of the enclosure as described above. Then, a cutting edge may be installed within the enclosure for cutting the adhesive strip 146 to open the cover and remove the sterilized vial and tray assemblies therefrom within the aseptic enclosure. If desired, the robot may manipulate the cutting implement to open the box and remove the tray, and/or the apparatus may include another robot for this function. The robot then may rotate the cover, remove the tray and install the tray on the tray support in the manner described above. As indicated in FIG. 26, the box may include sterilization indicators 148 to determine whether the box remains sterile with the double bag enclosure (not shown).

This patent application includes subject matter related to that disclosed in the following patent applications: U.S. patent application Ser. No. 10/766,172, filed Jan. 28, 2004, entitled "Medicament Vial Having A Heat-Sealable Cap, And Apparatus and Method For Filling The Vial", which is a continuation-in-part of similarly titled U.S. patent application Ser. No. 10/694,364, filed Oct. 27, 2003, now U.S. Pat. No. 6,805,170, which is a continuation of similarly titled U.S. patent application Ser. No. 10/393,966, filed Mar. 21, 2003, now U.S. Pat. No. 6,684,916, which is a divisional of similarly titled U.S. patent application Ser. No. 09/781,846, filed Feb. 12, 2001, now U.S. Pat. No. 6,604,561, issued Aug. 12, 2003, which, in turn, claims the benefit of similarly titled U.S. Provisional Application Ser. No. 60/182,139, filed Feb. 11, 2000; and U.S. Provisional Patent Application No. 60/442,526, filed Jan. 28, 2003; and similarly titled U.S. Provisional Patent Application No. 60/484,204, filed Jun. 30, 2003; U.S. patent application Ser. No. 10/655,455, entitled "Sealed Containers And Methods Of Making And Filling Same"; and U.S. Provisional Patent Application Ser. No. 60/518,685, entitled "Needle Filling And Laser Sealing Station". The foregoing patent applications and patent are assigned to the Assignee of the present invention and are hereby expressly incorporated by reference as part of the present disclosure.

As may be recognized by those skilled in the pertinent art based on the teachings herein, numerous changes and modifications may be made to the above-described and other embodiments of the present invention without departing from its scope as defined in the appended claims. For example, the resealable member may be integrally molded with the base such as by insert molding, the resealable member may be fused or otherwise melted to the base of the stopper, or the resealable member may be sequentially molded to the base. In addition, the resealable member may be made of any of numerous different materials which are currently known, or which later become known for performing the functions of the resealable member described herein, such as any of numerous different thermoplastic and/or elastomeric materials, including, for example, low-density polyethylene. Similarly, the base of the stopper can be made of vulcanized rubber as described above, or any of numerous other materials that are currently or later become known as being compatible with, or otherwise defining a stable enclosure for the particular medicament or other substance contained within the vial or other container. In addition, the resealable stoppers may include more than one layer of vulcanized rubber and/or more than one layer of resealable material. In addition, the cauterization and sealing stations may employ any of numerous different types of heat sources that are currently, or later become known, for performing the functions of the heat sources described herein, such as any of numerous different types of laser or other optical sources or conductive heat sources. Accordingly, this detailed description of the preferred embodiments is to be taken in an illustrative, as opposed to a limiting sense.

As may be recognized by those skilled in the pertinent art based on the teachings herein, numerous changes and modifications may be made to the above-described and other embodiments of the present invention without departing from its scope as defined in the appended claims. Accordingly, this detailed description of the preferred embodiments is to be taken in an illustrative, as opposed to a limiting sense.

What is claimed is:

1. An apparatus for filling and resealing devices having penetrable regions that are penetrable for filling the devices with a substance, and are resealable for sealing a hole formed therein upon withdrawal of a filling member therefrom, the apparatus comprising:

a device support movable between a plurality of positions and configured (i) to releasably retain at least one device having a penetrable region during movement of the device support between the plurality of positions, and (ii) to support the at least one device in a substantially fixed position during one or more of filling the device through the penetrable region or resealing a hole in the penetrable region formed upon withdrawal of a filling member therefrom;

a manifold drivingly mounted over the device support when the device support is in at least one of the plurality of positions, and comprising at least one filling member configured to penetrate a penetrable region of a device and introduce a substance through the at least one filling member and into said device; and at least one resealing apparatus configured to reseal a hole in said penetrable region formed by the at least one filling member.

2. An apparatus as defined in claim 1, wherein the at least one resealing apparatus includes an output for transmitting a laser beam therefrom and onto a penetrated region of the penetrable region.

3. An apparatus as defined in claim 1, wherein the at least one filling member comprises a plurality of filling members.

4. An apparatus as defined in claim 1, further comprising a radiation source for generating a radiation field, and wherein the device support moves the at least one device within the radiation field for sterilizing at least a penetrable and resealable portion thereof.

5. An apparatus as defined in claim 1, further comprising a controller for controlling relative movement of the manifold and the device support.

6. An apparatus as defined in claim 5, wherein the controller controls movement of one or more of the at least one filling member or the device support to align the at least one filling member and an underlying penetrable region, insert the at least one filling member into the penetrable region, introduce a substance through the at least one filling member and into an interior chamber of the device, withdraw the at least one filling member from the penetrable region, and reseal the penetrable region.

7. An apparatus as defined in claim 6, wherein the device support includes a tray that supports thereon a plurality of devices in fixed positions relative to each other and so as to form a matrix with a plurality of rows and columns of devices, and the controller controls relative movement of the manifold and device support to align the filling member with one or more underlying penetrable regions.

8. An apparatus as defined in claim 1, wherein the device support includes a drive unit for moving the device support relative to the manifold.

9. An apparatus as defined in claim 8, wherein the drive unit includes one or more of a drive belt, a lead screw, or a linear actuator, drivingly connected to the device support for moving the device support relative to the manifold.

10. An apparatus as defined in claim 1, wherein the device support includes a tray that supports thereon a plurality of devices in fixed positions relative to each other, the tray includes a plurality of connecting portions, and each connecting portion is releasably connectable to a respective device for connecting the device thereto and for releasably fixing the device on the tray.

11. An apparatus as defined in claim 10, further comprising a device fixture receivable within the tray and including a plurality of connecting portions thereon for releasably connecting the devices thereto.

12. An apparatus as defined in claim 10, wherein a plurality of the connecting portions are each defined by a recess for receiving therein a base portion of a respective device, and at least one flexible upstanding portion that is engagable with the base portion of the device to releasably secure the device thereto.

13. An apparatus as defined in claim 11, wherein the device fixture includes a plurality of connecting portions for releasably connecting and positioning the fixture within the tray.

14. An apparatus as defined in claim 1, further comprising a tray defining a plurality of recesses spaced relative to each other and connecting portions located adjacent to the recesses, and wherein the device defines a substantially cylindrical base and the connecting portions are defined by at least two upstanding flexible portions that flexibly engage the base to releasably secure the base within the respective recess.

15. An apparatus as defined in claim 10, further comprising a housing defining an internal chamber configured to receive therein at least one tray including a plurality of sealed empty devices mounted thereon, an access opening formed through the housing and permitting movement of the at least one tray therethrough, a cover movable between a closing position covering the access opening and forming a substantially fluid-tight seal therebetween to seal the at least one tray within the internal chamber, and an open position permitting movement of the at least one tray within the internal chamber.

16. An apparatus as defined in claim 1, further comprising a laminar flow source for introducing a substantially laminar flow of sterile gas that is one or more of (1) directed vertically or (2) directed horizontally, over the at least one filling member and the device.

17. An apparatus as defined in claim 10, wherein the connecting portions substantially prevent movement of the devices relative to the tray during one or more of filling or resealing thereof.

18. An apparatus as defined in claim 1, further comprising a robotic arm drivingly mounted adjacent to the device support, wherein the manifold is drivingly mounted on the robotic arm and is movable laterally relative to the device on the device support to position the manifold relative to a penetrable region of the device.

19. An apparatus as defined in claim 1, wherein one or more of the device support or the at least one filling member is drivingly movable relative to the other in at least three coordinate directions so that the filling member penetrates a penetrable region.

20. An apparatus as defined in claim 1, wherein the at least one filling member is supported by a driven portion of a robot.

21. An apparatus as defined in claim 20, wherein the driven portion is movable in at least three coordinate directions.

22. An apparatus as defined in claim 1, further comprising a temperature sensor configured to sense a temperature achieved by resealing to determine whether the hole is resealed.

23. An apparatus as defined in claim 22, further adapted to compare said temperature sensed by the temperature sensor to at least one predetermined temperature to determine whether the hole is resealed.

24. An apparatus for filling and resealing devices having penetrable regions that are penetrable for filling the devices with a substance, and are resealable for sealing a hole formed therein upon withdrawal of a filling member therefrom, the apparatus comprising:

a device support movable between a plurality of positions and configured (i) to releasably retain at least one device having a penetrable region during movement of the device support between the plurality of positions, and (ii) to support the at least one device in a substantially fixed position during one or more of filling the device through the penetrable region or resealing a hole in the penetrable region formed upon withdrawal of a filling member therefrom;

a manifold comprising at least one filling member configured to penetrate a penetrable region of a device and introduce a substance through the at least one filling member and into said device, wherein one or more of the device support and the manifold are drivingly movable relative to the other so as to penetrate a penetrable region of a device with the at least one filling member; and at least one resealing apparatus configured to reseal a hole in said penetrable region formed by the at least one filling member.

25. An apparatus as defined in claim 24, wherein the at least one resealing apparatus includes an output for transmitting a laser beam therefrom and onto a penetrated region of the penetrable region.

26. An apparatus as defined in claim 24, wherein the at least one filling member comprises a plurality of filling members.

27. An apparatus as defined in claim 24, further comprising a controller configured to control relative movement of the manifold and the device support.

28. An apparatus as defined in claim 27, wherein the controller controls movement of one or more of the at least one filling member or the device support to one or more of align the at least one filling member and an underlying penetrable region, insert the at least one filling member into the penetrable region, introduce a substance through the at least one filling member and into an interior chamber of the device, withdraw the at least one filling member from the penetrable region, or reseal the penetrable region.

29. An apparatus as defined in claim 24, wherein the device support includes a drive unit for moving the device support relative to the manifold.

30. An apparatus as defined in claim 24, further comprising a robotic arm drivingly mounted to the apparatus, wherein the manifold is drivingly mounted on the robotic arm and is movable relative to a device on the device support.

31. An apparatus for filling and resealing devices having penetrable regions that are penetrable for filling the devices with a substance, and are resealable for sealing a hole formed therein upon withdrawal of a filling member therefrom, the apparatus comprising:

a device support movable between a plurality of positions and configured to support at least one device having a penetrable region in a substantially fixed position during one or more of filling the device through the penetrable region or resealing a hole in the penetrable region formed upon withdrawal of a filling member therefrom; wherein the device support supports thereon a plurality of devices in fixed positions relative to each other, the support includes a plurality of connecting portions, and each connecting portion is releasably connectable to a respective device for connecting the respective device thereto and for releasably fixing the respective device on the support;

a manifold drivingly mounted over the device support when the device support is in at least one of the plurality of positions, and comprising at least one filling member configured to penetrate a penetrable region of a device and introduce a substance through the at least one filling member and into said device; and at least one resealing apparatus configured to reseal a hole in said penetrable region formed by the at least one filling member.

32. An apparatus for filling and resealing devices having penetrable regions that are penetrable for filling the devices with a substance, and are resealable for sealing a hole formed therein upon withdrawal of a filling member therefrom, the apparatus comprising:

a device support movable between a plurality of positions and configured to support at least one device having a penetrable region in a substantially fixed position during one or more of filling the device through the penetrable region or resealing a hole in the penetrable region formed upon withdrawal of a filling member therefrom; wherein the device support supports thereon a plurality of devices in fixed positions relative to each other, the support includes a plurality of connecting portions, and each connecting portion is releasably connectable to a respective device for connecting the respective device thereto and for releasably fixing the respective device on the support;

a manifold comprising at least one filling member configured to penetrate a penetrable region of a device and introduce a substance through the at least one filling member and into said device, wherein one or more of the device support and the manifold are drivingly movable relative to the other so as to penetrate a penetrable region of a device with the at least one filling member; and at least one resealing apparatus configured to reseal a hole in said penetrable region formed by the at least one filling member.

33. An apparatus comprising:

a device support configured to support at least one device having a penetrable region in a substantially fixed position during one or more of filling the device through the penetrable region or resealing a hole in the penetrable region upon withdrawal of a filling member therefrom;

a manifold drivingly mounted over the device support and comprising at least one filling member configured to penetrate the penetrable region and introduce a substance through the at least one filling member and into said device;

at least one resealing apparatus configured to reseal a hole in said penetrable region formed by the at least one filling member; and a temperature sensor configured to sense a temperature achieved on the device by resealing to determine whether the hole is resealed.

34. An apparatus as defined in claim 33, further adapted to compare said temperature to at least one predetermined temperature to determine whether the hole is resealed.

* * * * *